US009175862B2

(12) United States Patent
Chtchetinin

(10) Patent No.: US 9,175,862 B2
(45) Date of Patent: Nov. 3, 2015

(54) BUILT-IN RETRACTABLE VENTILATION HOOD ASSEMBLY

(71) Applicant: Mikhail Chtchetinin, Campbell, CA (US)

(72) Inventor: Mikhail Chtchetinin, Campbell, CA (US)

( * ) Notice: Subject to any disclaimer, the term of this patent is extended or adjusted under 35 U.S.C. 154(b) by 177 days.

(21) Appl. No.: 14/093,512

(22) Filed: Dec. 1, 2013

(65) Prior Publication Data

US 2014/0083412 A1 Mar. 27, 2014

Related U.S. Application Data

(63) Continuation-in-part of application No. 13/270,228, filed on Oct. 11, 2011, now abandoned.

(51) Int. Cl.
*F24C 15/20* (2006.01)
*A47B 77/08* (2006.01)

(52) U.S. Cl.
CPC ..... *F24C 15/2092* (2013.01); *A47B 77/08* (2013.01)

(58) Field of Classification Search
CPC ..... F24C 15/2092
See application file for complete search history.

(56) References Cited

U.S. PATENT DOCUMENTS

| | | | | | |
|---|---|---|---|---|---|
| 3,031,946 | A * | 5/1962 | Watt et al. | 126/299 R |
| 3,249,037 | A * | 5/1966 | Stalker | 126/299 E |
| 3,356,008 | A * | 12/1967 | Simpson et al. | 126/299 D |
| 3,496,704 | A * | 2/1970 | Bandlow | 96/138 |
| 6,797,930 | B2 * | 9/2004 | Kim | 219/757 |
| 2006/0128298 | A1 * | 6/2006 | Grobleben et al. | 454/56 |
| 2009/0241934 | A1 * | 10/2009 | Canavari | 126/299 D |
| 2010/0200578 | A1 * | 8/2010 | Song et al. | 219/757 |
| 2015/0083106 | A1 * | 3/2015 | Jeong et al. | 126/21 A |

* cited by examiner

*Primary Examiner* — Gary Hoge
(74) *Attorney, Agent, or Firm* — Georgiy L. Khayet

(57) ABSTRACT

A built-in ventilation hood assembly is designed for installation into a kitchen cabinet immediately above a built-in cooking device. The assembly includes a housing and a retractable hood unit, which may include at least one air intake into which air is drawn; and the housing may include at least one opening for exhaustion of the air taken into the housing. The assembly may also include at least one telescoping linear actuator configured to slide the retractable hood unit out from the housing and back into the housing when needed. The assembly may also include an air blower installed within a rear end of the housing. The air blower includes one, two, or more cross flow fans for uniform exhausting the air out of the housing. The housing may also include an external rectangular duct.

16 Claims, 23 Drawing Sheets

BUILT-IN RETRACTABLE VENTILATION HOOD ASSEMBLY

CROSS-REFERENCE TO RELATED APPLICATIONS

This application is Continuation-in-Part of U.S. Utility patent application Ser. No. 13/270,228, filed on Oct. 11, 2011, entitled "Built-In Retractable Ventilation Hood Assembly," which is incorporated herein by reference in its entirety for all purposes.

TECHNICAL FIELD

The present disclosure relates generally to ventilation hoods. More particularly, the present disclosure relates to a retractable built-in kitchen hood for ventilating the area around a built-in cooking device such as a wall oven.

DISCUSSION OF RELATED ART

The approaches described in this section could be pursued, but are not necessarily approaches that have previously been conceived or pursued. Therefore, unless otherwise indicated, it should not be assumed that any of the approaches described in this section qualify as prior art merely by virtue of their inclusion in this section.

Cooking may create undesirable products such as combustion gases, food smells, heat, steam, grease, and so forth. These products may pollute the air in a kitchen and even be harmful and hazardous for people. It is traditionally desirable to safely remove these products from the cooking area to outside.

Various kitchen ventilation hoods have been developed to draw the gas products away from the kitchen. The ventilation hoods are conventionally disposed above the cooking area because gas products generally possess high temperatures, which cause them to flow upwards. Typical kitchen ventilation hoods include a fan configured to exhaust gas products to an outdoor space and a metal casing made in a form suitable for collecting gas products from the wide cooking area.

Most ventilation hoods are designed to be installed above stovetops; however, a typical kitchen may comprise many other cooking devices that can also produce undesirable gas products. Among such cooking devices are various built-in cooking devices including wall ovens, microwave ovens, and the like, which are typically built into the kitchen cabinetry. There is no any effective ventilation hood for removing gas products generated by such built-in cooking devices.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

In accordance with various embodiments and the corresponding disclosure thereof, a built-in ventilation hood assembly for air exhausting is provided. The ventilation hood is designed for installation into a kitchen cabinet immediately above a cooking device (e.g., a built-in oven) being built into the same kitchen cabinet for air exhausting from the area around the built-in cooking device. The ventilation hood includes a housing and a retractable hood unit configured to be slidably mounted within the housing. The retractable hood unit may include at least one air intake into which air is drawn. The housing may include at least one opening (e.g., in its top wall) for exhaustion of the air taken into the housing by the retractable hood.

The ventilation hood assembly may also include at least one linear actuator configured to move the retractable hood unit out of the housing and move the retractable hood unit back into the housing when needed. The linear actuator may be stationary, either secured to the bottom wall or the top wall of the housing or secured to the retractable hood unit. The ventilation hood assembly may also include an air blower installed within the housing and in a rear end of the housing. The blower is configured to draw air into the housing through at least one air intake of the retractable hood unit and exhaust the air out of the housing through the opening. The air blower includes one, two, or more cross flow fans. If two cross flow fans are utilized, they can be driven by a single electrical motor. For example, two cross flow fans may be built onto a single shaft.

The opening(s) of the housing for air exhaustion may be of a rectangular shape with dimensions being substantially equal to the dimensions of the cross flow fan(s). The housing may also be designed for attaching an external duct for transferring the air from the housing to the outside (for example, out of a building). The external duct may be also of rectangular shape to cover the rectangular opening(s). The width of the external rectangular duct may be substantially the same as the width of the housing, while the depth of the external rectangular duct is about ⅓ of the depth of the housing (e.g., about 2-5 inches).

The ventilation hood assembly may also include one or more guides, rails, racks, or other elements to make it easy for the retractable hood unit to slide in and out of the housing. In another embodiment, two or more bearing slides are provided. The bearing slides may be secured to the side walls of the housing and optionally to the bottom and top walls of the housing. Further, the ventilation hood assembly may also include one or more air guides within the housing for guiding the air from the air intake(s) of the retractable hood unit to the opening of the housing and further to the external retractable hood. The air guides may include flexible ducts such as corrugated ducts or the like.

The ventilation hood assembly may also include a control panel having one or more buttons to activate various operation modes, which may include the control over the cross flow fans, lighting, position of the retractable hood unit, and so forth. In one example, pressing on at least one of the buttons causes the retractable hood unit to slide out of or into the housing by actuating the linear actuator, which pushes or pulls the retractable hood unit with a predetermined speed. In another example, one press on the at least one button causes the retractable hood unit to slide a first predetermined distance out of the housing, and another press on the at least one button causes the retractable hood unit to slide a second predetermined distance out of the housing. In yet another example, the press on the at least one button further causes activation of the air blower, and a rotation speed of the air blower depends on a position of the retractable hood unit being slid out the housing.

The ventilation hood assembly may also include one or more light emitting devices arranged on a front side of the retractable hood unit. The light emitting devices may be automatically activated when the retractable hood unit is slid out of the housing. In addition, the light emitting devices are configured to eliminate light substantially flatwise of the front side of the retractable hood unit for warning a user.

To the accomplishment of the foregoing and related ends, the one or more aspects comprise the features hereinafter fully described and particularly pointed out in the claims. The following description and the drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

Embodiments are illustrated by way of example and not limitation in the figures of the accompanying drawings, in which like references indicate similar elements and in which.

DETAILED DESCRIPTION

Figure 1:
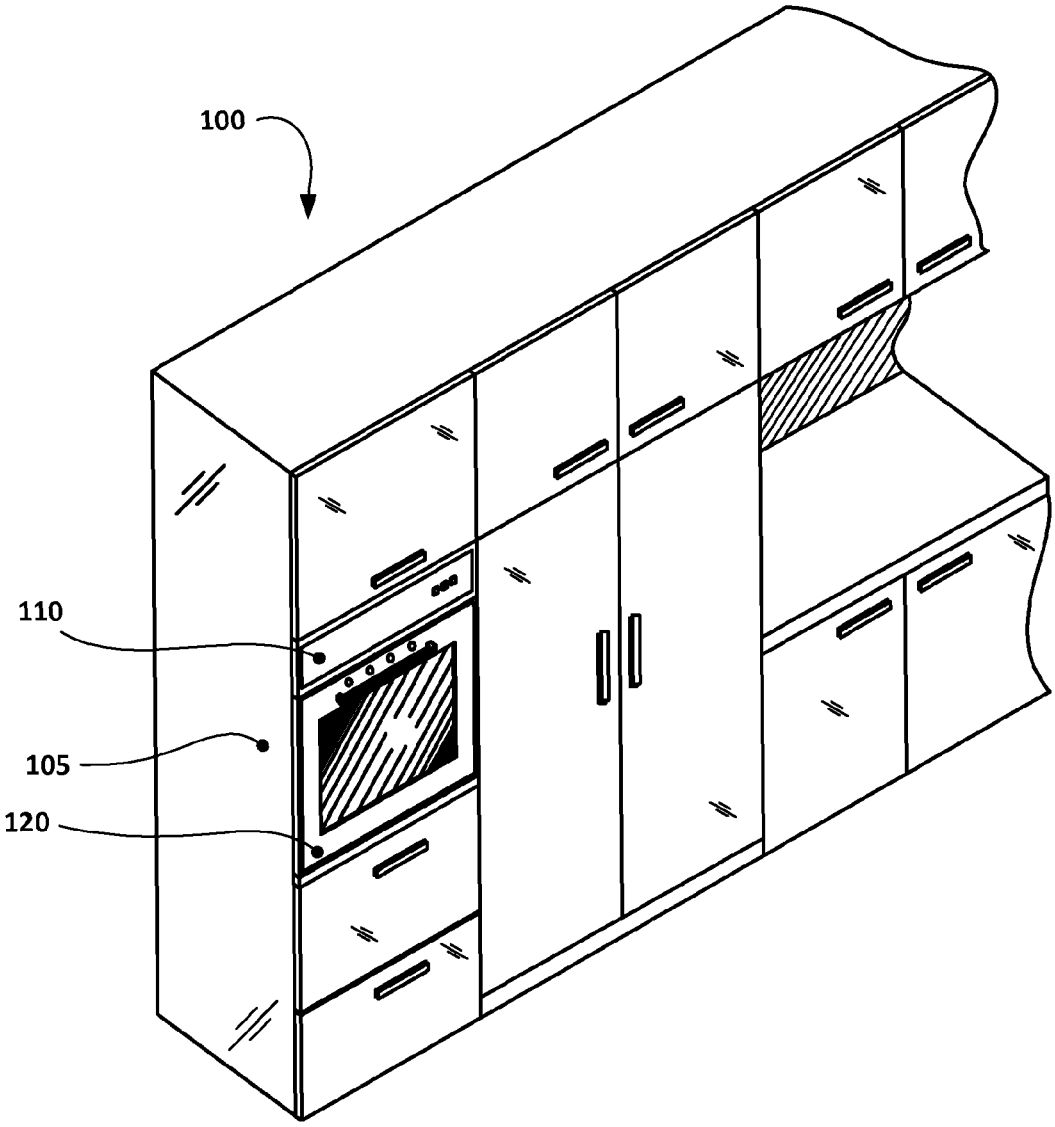
FIG. 1 is a diagrammatic perspective view of a kitchen cabinetry having a built-in ventilation hood assembly in a retracted position, according to an example embodiment.

The following detailed description includes references to the accompanying drawings, which form a part of the detailed description. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and electrical changes can be made without departing from the scope of what is claimed. The following detailed description is, therefore, not to be taken in a limiting sense, and the scope is defined by the appended claims and their equivalents.

According to various embodiments disclosed herein, a built-in ventilation hood assembly for air exhausting is provided. The built-in ventilation hood assembly can be embedded in a kitchen cabinet above a built-in cooking device such as a wall oven. Accordingly, the built-in ventilation hood assembly is designed to remove undesired gas products generated by the cooking device.

In various embodiments, the built-in ventilation hood assembly is embedded into a kitchen cabinet immediately above a built-in cooking device to provide better air exhaustion. In some embodiments, the built-in ventilation hood assembly is integrated into the same kitchen cabinet into which the cooking device is built. In additional embodiments, the built-in ventilation hood assembly may be connected (secured or embedded) to the built-in cooking device. The connection can be mechanical and/or electrical. For example, the built-in ventilation hood assembly may be fixedly attached to the cooking device (e.g., screwed on with bolts). In another example, the built-in ventilation hood assembly may also be operatively (electrically) connected to the cooking device for supplying power or transmitting control signals. In certain embodiments, the built-in ventilation hood assembly may be activated by control commands received from the cooking device.

Embodiment 1

The built-in ventilation hood assembly may comprise a housing, a ventilation unit installed therein, and a retractable hood unit which can be slidably mounted within the housing. The retractable hood unit may be driven by a user with the help of a driving unit (e.g., an electric motor) that can cause the hood to move from the retracted position to an extended position, and vice versa. In some embodiments, the retractable hood unit can be moved out from the housing on predetermined lengths (e.g., on a half length and a full length).

The retractable hood unit may include an air intake (e.g., one or more openings or windows arranged on its bottom wall) for exhausting air from the cooking area to an outside area. One or more filters, such as grease filters, carbon filters, and textile filters, can be inserted into the one or more openings. Accordingly, when the retractable hood unit is extended from the housing, the air can be exhausted through the air intake and be forced through the ventilation unit to an external air conduit (duct) or to an air filter and then back to the cooking area.

The built-in ventilation hood assembly may also be provided with a transmission unit configured to transmit the force generated by the driving unit to the retractable hood unit. In one example, the transmission unit may comprise a gear coupled to the driving unit and a rack coupled with the retractable hood unit. Accordingly, the force of the driving unit can be transmitted via the transmission unit to the retractable hood unit for sliding in or out of the housing.

The built-in ventilation hood assembly may also include multiple illumination devices to light the cooking area and/or light certain parts of the assembly (e.g., corners, side walls, etc.). It was shown that warning lights on the boundaries of the assembly help people be more careful, and the number of injures can be significantly reduced.

Figure 2:
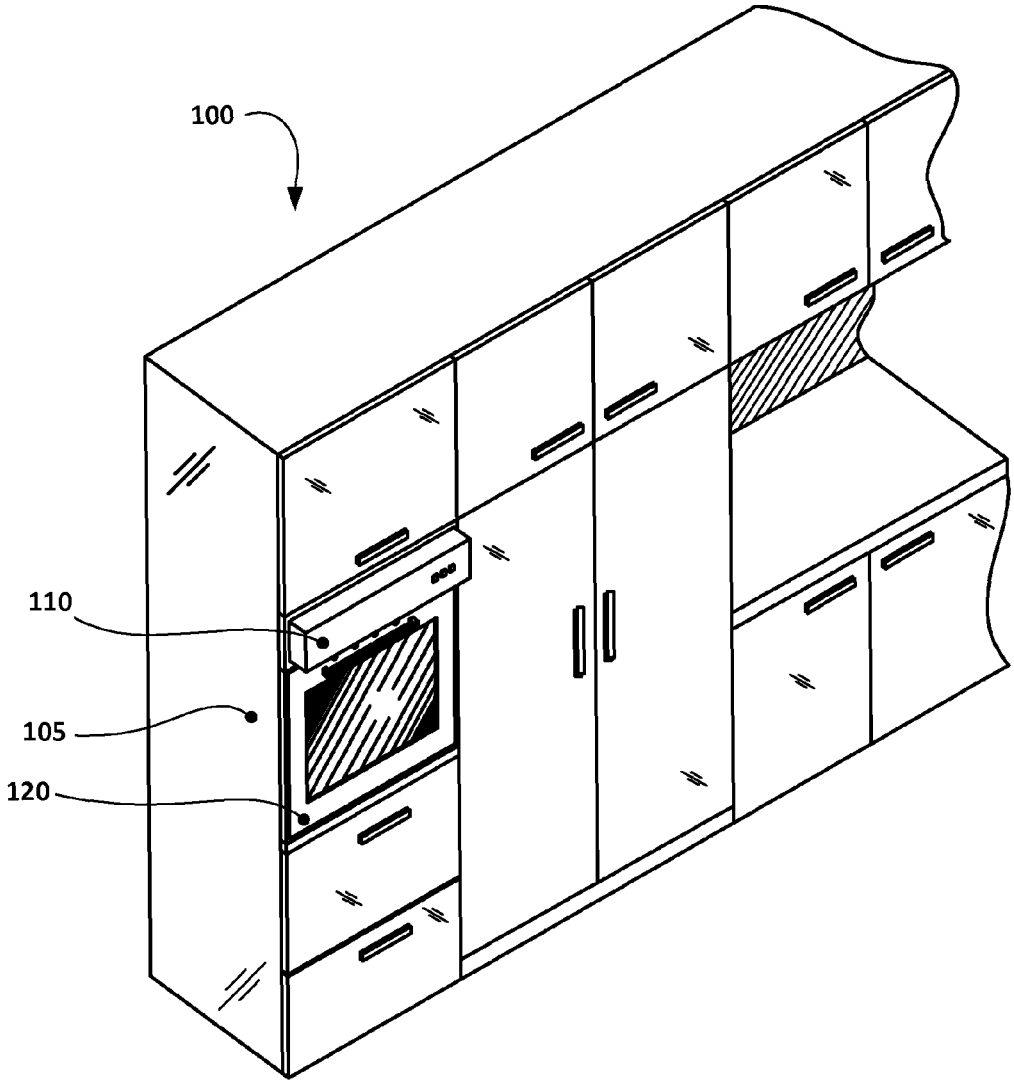
FIG. 2 is a perspective view of the kitchen cabinetry having the built-in ventilation hood assembly in an extended position, according to an example embodiment.

Referring now to the drawings, FIG. 1 shows a diagrammatic perspective view of a kitchen cabinetry 100 having at least one kitchen cabinet 105 within which a built-in ventilation hood assembly 110 and a built-in cooking device 120 are embedded. The built-in ventilation hood assembly 110 is shown in its retracted position. As shown in the figure, the built-in ventilation hood assembly 110 is disposed above the cooking device 120, preferably immediately above the cooking device 120. In some embodiments, the built-in ventilation hood assembly 110 may be operatively coupled to the cooking device 120 or be integrated with the cooking device 120. The cooking device 120 may include a built-in oven, wall oven, wall microwave oven, or the like, and may generate heat provided to food for cooking. Accordingly, the built-in ventilation hood assembly 110 can be activated when the cooking device 120 is in use. FIG. 2 shows a perspective view of the kitchen cabinetry 100 having the built-in ventilation hood assembly 110 in an extended (slide out) position according to an example embodiment.

The built-in ventilation hood assembly 110 may be coupled to an air conduit (not shown) to remove exhausted air to an outside area. Thus, gas products generated during the cooking process may be exhausted by the built-in ventilation hood assembly 110 and forced to the outside area through a set of conduits. In some examples, the built-in ventilation hood assembly 110 may comprise an air filter and an outlet (not shown) to force treated air back to the cooking area. According to some embodiments, the built-in ventilation hood assembly 110 can be extended from the moved-in position to a certain length depending on current needs.

Figure 3:
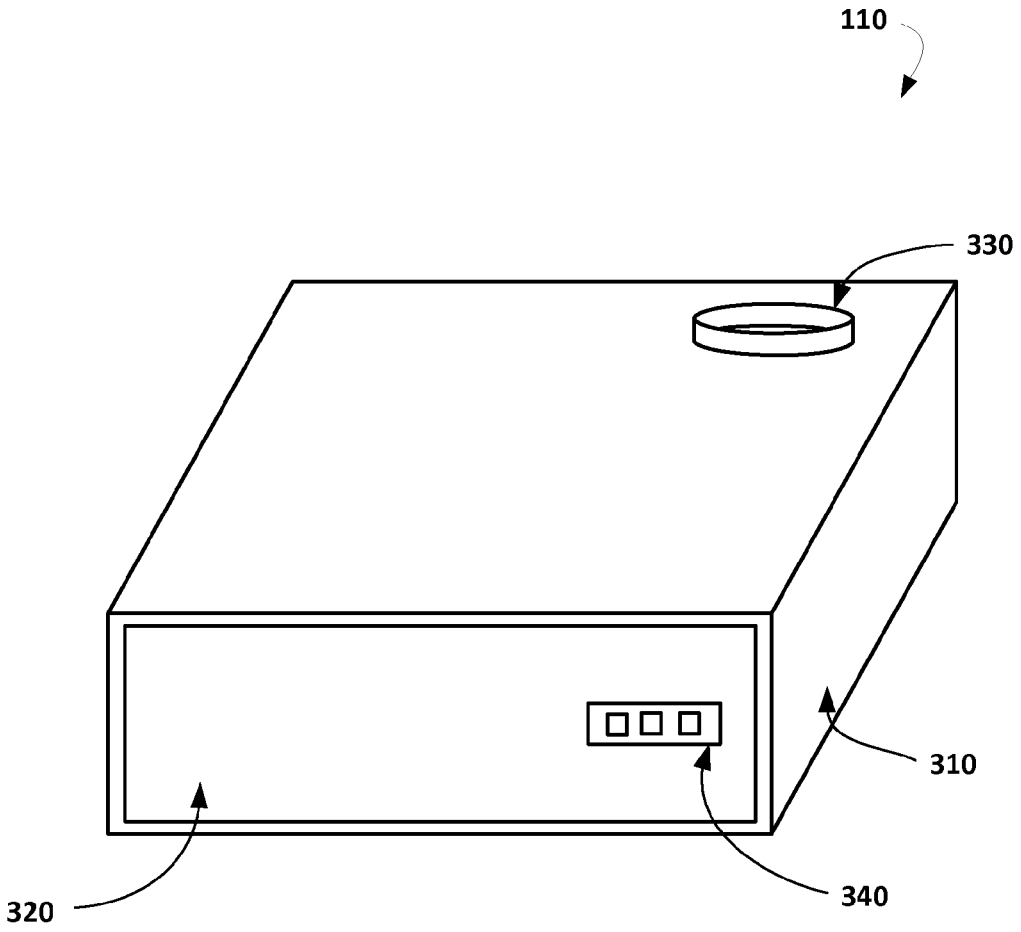
FIG. 3 is a perspective view of the built-in ventilation hood assembly, according to an example embodiment.

FIG. 3 is a perspective view of the built-in ventilation hood assembly 110, according to an example embodiment. As shown, the built-in ventilation hood assembly 110 may comprise a housing 310, a retractable hood unit 320, and an air outlet 330 designed for coupling with an external air conduit. As shown in this figure, the retractable hood unit 320 is retracted within the housing 310. The housing 310 and the retractable hood unit 320 both have rectangular parallelepiped forms such that the retractable hood unit 320 may slide in or out of the housing 310.

The built-in ventilation hood assembly 110 may further include a control panel 340. The control panel 340 may be arranged on the front panel of the retractable hood unit 320 or on any other wall of the built-in ventilation hood assembly 110. The control panel 340 may include one or more buttons or other electronic devices to control different units of the built-in ventilation hood assembly 110. In particular, the control panel 340 may provide control over a ventilation unit, a driving unit to slide the retractable hood unit 320 in or out, and various illumination devices.

Figure 4:
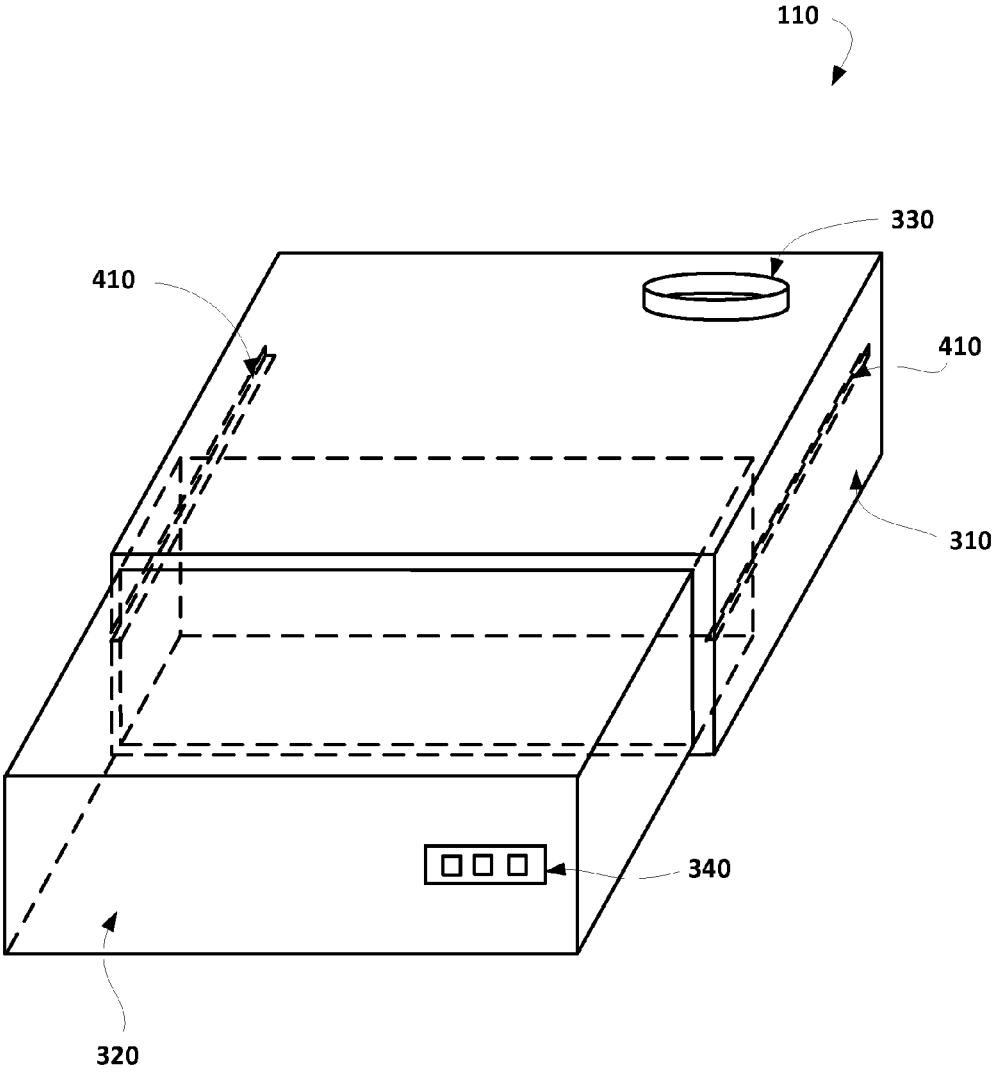
FIG. 4 is a perspective view of the built-in ventilation hood assembly having the retractable hood unit in the extended position, according to an example embodiment.

FIG. 4 is a perspective view of the built-in ventilation hood assembly 110 having the retractable hood unit 320 in the slide out (extended) position, according to an example embodiment. As mentioned, the retractable hood unit 320 may be slidably positioned within the housing 310. In order to provide the ability of moving the retractable hood unit 310, the housing 310 may comprise one or more guiding members 410 (shown in dashed lines) to receive the retractable hood unit 320. The guiding members 410 may include, among other things, rails, racks, guides, ramps, ribs, shafts, and bearing slides.

Figure 5:
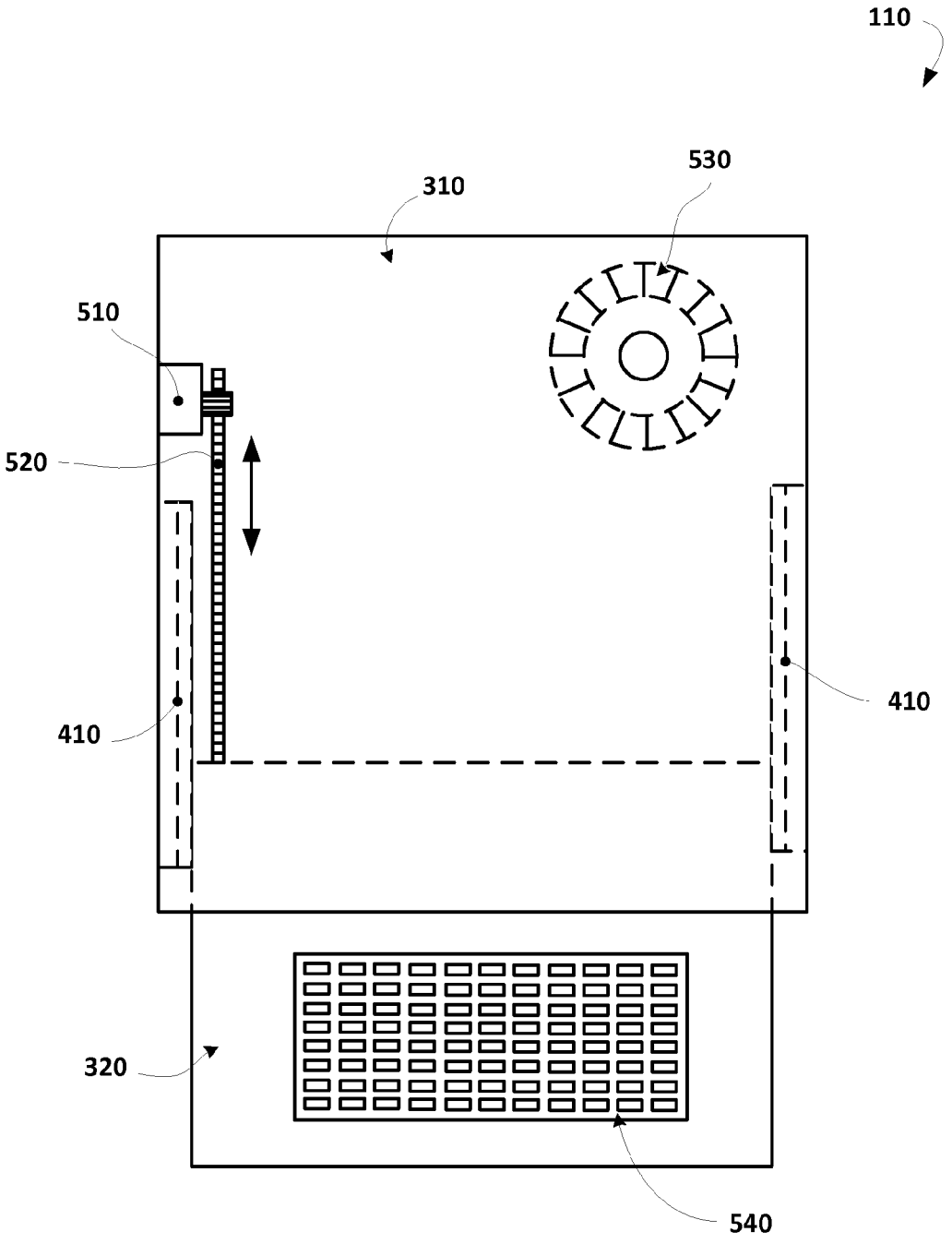
FIG. 5 is a diagrammatic top view of a longitudinal section of the built-in ventilation hood assembly having the retractable hood unit in the slide out position, according to an example embodiment.

FIG. 5 is a diagrammatic top view of longitudinal section of the built-in ventilation hood assembly 110 having the retractable hood unit 320 in the slide out position, according to an example embodiment. The sliding of the retractable hood unit 320 is performed with the help of the guiding members 410 disposed within the housing 310. In the example shown, the guiding members 410 are rails or bearing slides. In one exemplary embodiment, the guiding members 410 may form a channel to receive the retractable hood unit 320.

The built-in ventilation hood assembly 110 may further include a driving unit 510 disposed within the housing 310. The driving unit 510 may be configured to generate forces necessary for moving the retractable hood unit 320 along the guiding members 410. In one example, the driving unit 510 comprises one or more electric motors disposed within the housing 310 (e.g., fixedly attached to one or more walls of the housing 310). In the example shown, there is only one driving unit 510, although those skilled in the art would appreciate that any number of electric motors can be used and disposed in different positions within the housing 310.

The driving unit 510 may further include a transmission unit configured to transmit the force generated by the driving unit 510 to the retractable hood unit 320. The transmission unit can be designed in many suitable variants and comprise one or more of gears, shafts, racks, drive bands, chains, bearing slides, and so forth. In the example shown, the transmission unit is made in the form of a gear coupled to the electric motor axis and a rack 520 movably attached to the gear at one end and stationary coupled to the housing of the retractable hood unit 320 at the other end. When the driving unit 510 rotates its axis, the driving force is transmitted through the gear to the rack 520 such that it can move in reverse or forward directions, and displace the retractable hood unit 320 from the retracted position to the extended (slide out) position or vice versa.

The built-in ventilation hood assembly 110 may further include a ventilation unit 530 which can be installed within the housing 310 (e.g., secured to its top wall). The ventilation unit 530 can be configured to draw air in through at least one air intake 540 and drive it out to the air outlet 330. The ventilation unit 530 may comprise at least one fan to drive air. However, the ventilation unit 530 may further comprise one or more ducts and/or one or more air guiding members to guide air within the housing 310.

The retractable hood unit 320 may include one or more air intakes 540 arranged in its bottom wall. The air intake 540 may have one or more openings or windows. The air intake 540 may also include a grease filter, a carbon filter, or the like. In some other embodiments, the retractable hood unit 320 may include two air intakes 540, which are arranged in such a way that when the retractable hood unit 320 is extended to its half-length, it uses a first air intake only, but when the retractable hood unit 320 is extended to its full length, both air intakes are in use. In the latter case, the intake area can be extended when necessary to exhaust air in a more intensive manner.

Figure 6:
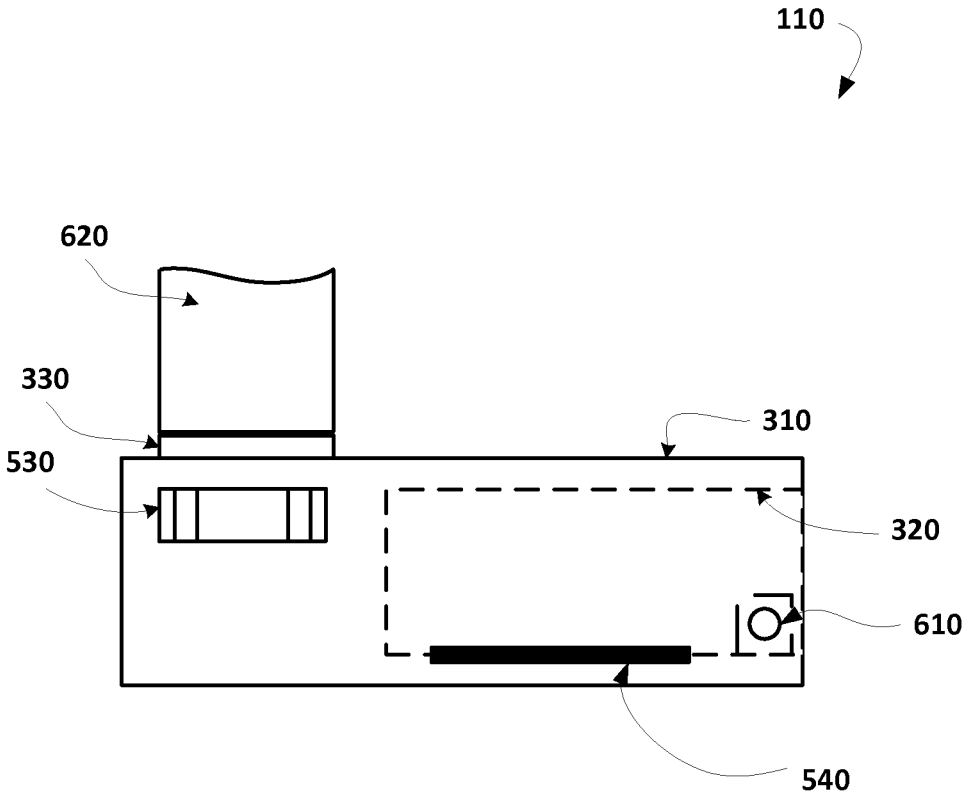
FIG. 6 is a diagrammatic side view of the built-in ventilation hood assembly having the retractable hood unit in the slide in position, according to an example embodiment.

FIG. 6 is a diagrammatic side view of the built-in ventilation hood assembly 110 having the retractable hood unit 320 in the slide in (retracted) position, according to an example embodiment. FIG. 6 further illustrates that the built-in ventilation hood assembly 110 may be provided with one or more illumination devices 610 and at least one external duct or conduit 620. The illumination devices 610 can be configured to light the cooking area (e.g., the front side of built-in oven 120) and may comprise one or more of light emitting devices such as luminous tube lamps, filament lamps, light emitting devices (LEDs), energy-saving lamps, and so forth. The air outlet 330 is shown in this figure as including a flange which is suitable for attaching the external duct 620. The external duct 620 may have any suitable shape or design and include, for example, a round duct or rectangular duct.

Figure 7:
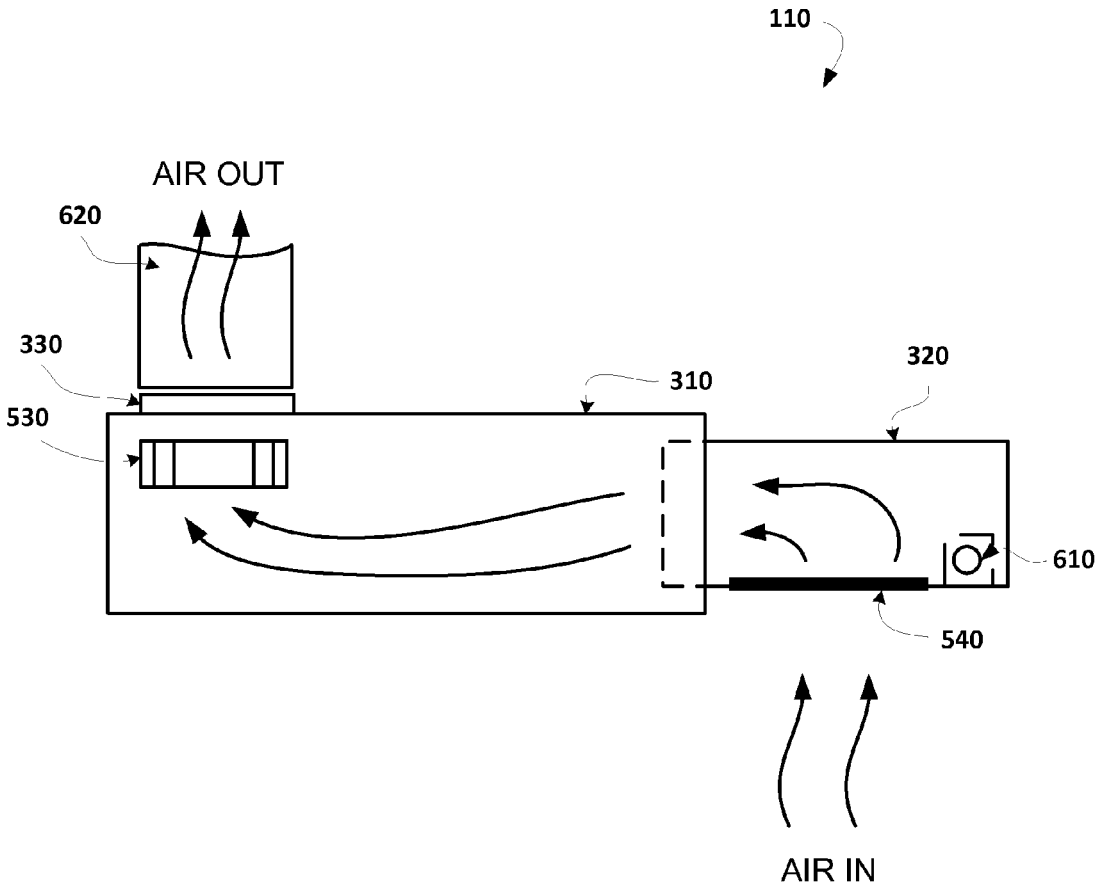
FIG. 7 is a diagrammatic side view of the longitudinal section of the built-in ventilation hood assembly having the retractable hood unit in the slide out position, according to an example embodiment.

FIG. 7 is a diagrammatic side view of a longitudinal section of the built-in ventilation hood assembly 110 having the retractable hood unit 320 in the slide out position, according to an example embodiment. FIG. 7 shows how the exhausted air can be forced within the built-in ventilation hood assembly 110. When the retractable hood unit 320 is in the slide out position, the air flow may be sucked through the air intake 540 to the internal compartment of the retractable hood unit 320 and then to an internal compartment of the housing 310. The air flow is then driven to the ventilation unit 530 and forced outside via the air outlet 330. It should be also noted that the built-in ventilation hood assembly 110 may include one or more internal conduits which may guide the air flow within the assembly 110 from the air intake 540 towards the air outlet 330.

Figure 8:
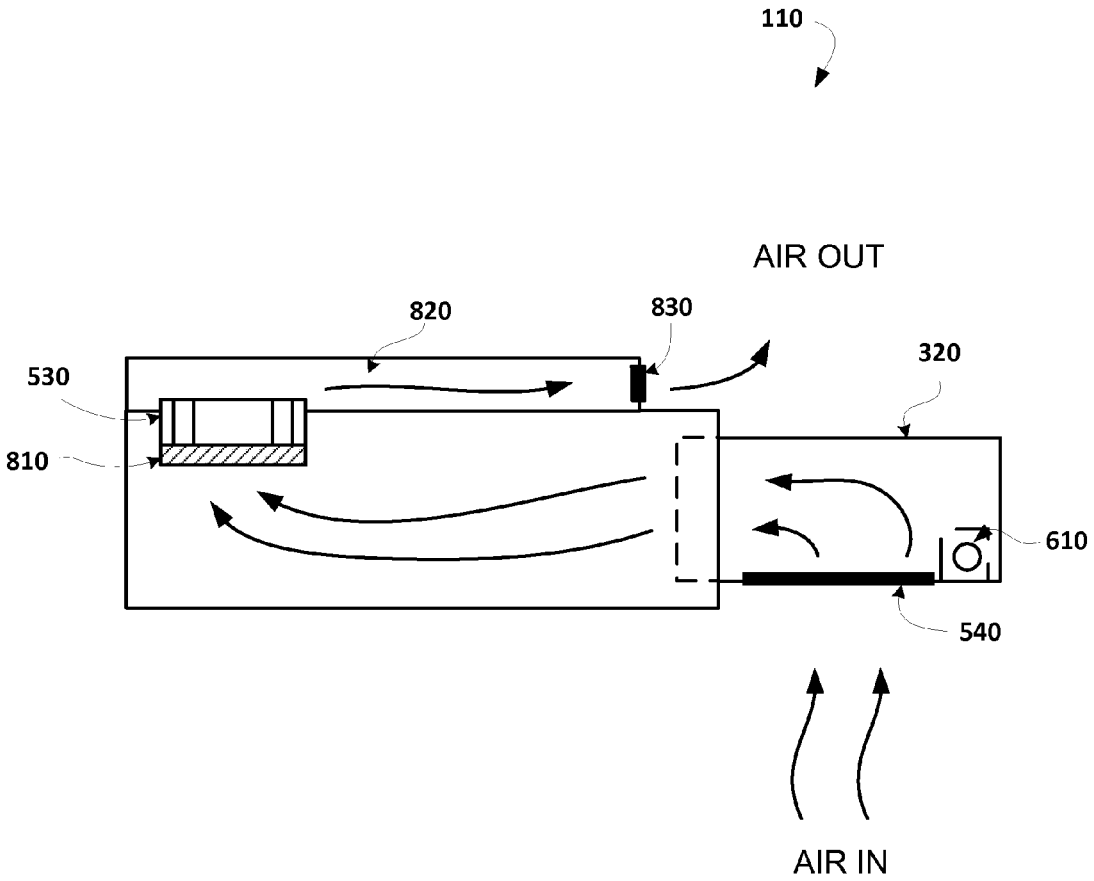
FIG. 8 shows a diagrammatic side view of the longitudinal section of the built-in ventilation hood assembly having the retractable hood unit in the slide out position, according to another example embodiment.

FIG. 8 shows a diagrammatic side view of the built-in ventilation hood assembly 110 having the retractable hood unit 320 in the slide out position, according to another example embodiment. In this embodiment, the built-in ventilation hood assembly 110 is similar to the previously described embodiments; however, in the shown example, the built-in ventilation hood assembly 110 may further include a filtering unit 810 configured to treat the drawn air. The filtering unit 810 may be implemented as a carbon filter or grease filter and can be integrated with a duct or the ventilation unit 530. The filtering unit 810 may either be arranged in front of the fan (of the ventilation unit 530) or behind of it.

The built-in ventilation hood assembly 110 may further comprise a duct 820 to transmit the treated air to an air outlet 830 such that the treated air can be returned to the cooking area. According to various embodiments, the built-in ventilation hood assembly 110 may comprise both air outlets 330 and 830 and, additionally, a switch (not shown) to redirect air flow to any one of these outlets. Such a switch can be arranged as an air guide member (for example, a moveable baffle (not shown)).

Figure 9:
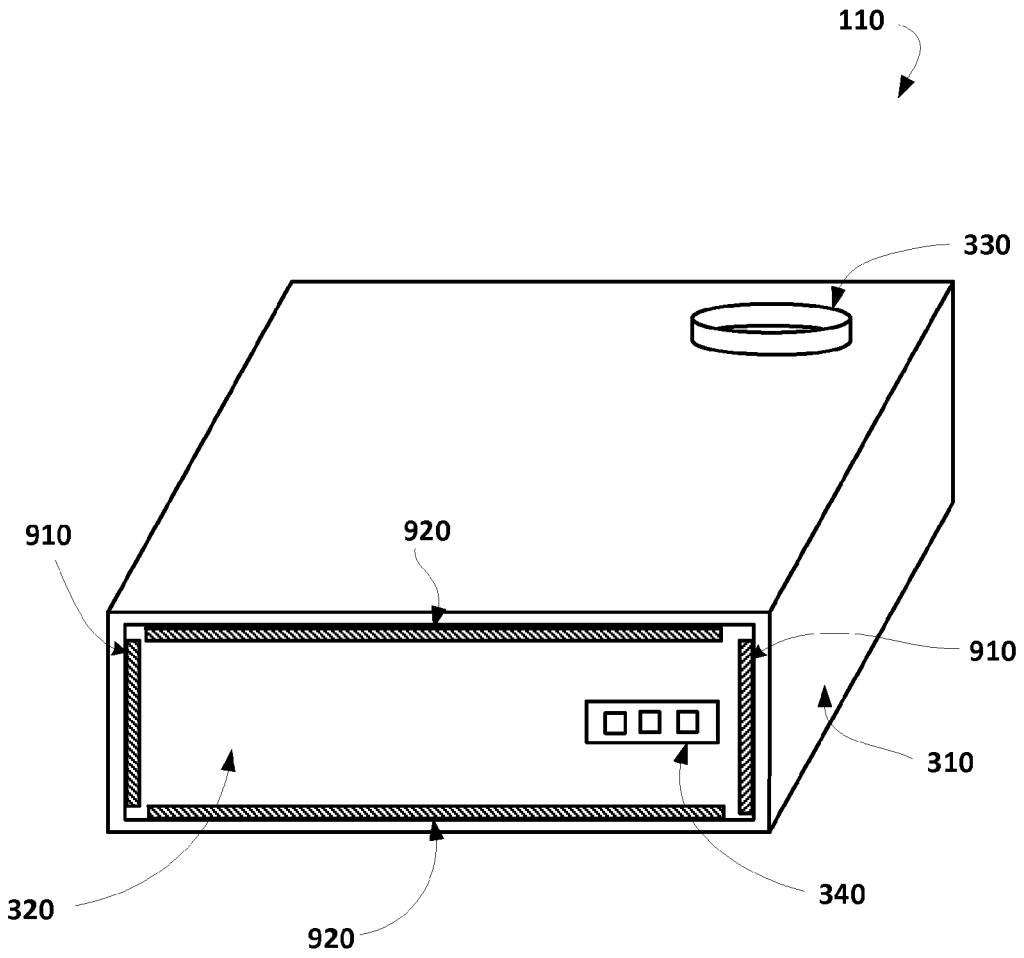
FIG. 9 shows a perspective view of the built-in ventilation hood assembly, according to an example embodiment.

FIG. 9 shows a perspective view of the built-in ventilation hood assembly 110, according to an example embodiment. As shown, the built-in ventilation hood assembly 110 may include the housing 310, the retractable hood unit 320, the air outlet 330, and the control panel 340. In this embodiment, the built-in ventilation hood assembly 110 may further comprise warning lights 910. The warning lights 910 can be arranged on the front panel of the retractable hood unit 320 and/or at the housing 310.

The warning lights 910 can be configured to warn users and highlight the angles or any boundaries of the built-in ventilation hood assembly 110. In this regard, the warning lights 910 can eliminate light substantially flatwise of the front side of the retractable hood unit 320 for warning a user. In the shown example, the warning lights 910 are disposed around the perimeter of the front panel of the retractable hood unit 320. The warning lights 910 may comprise one or more of light emitting devices such as luminous tube lamps, filament lamps, LEDs, energy-saving lamps, and the like. The warning lights 910 may draw the user's attention in order to prevent the user from being injured by accidently hitting his or her head or any other body parts on the built-in ventilation hood assembly 110 when its retractable hood unit 320 is in the extended position. In one example embodiment, the warning lights 910 can be automatically turned on when the ventilation unit 530 is activated, and similarly, when the ventilation unit 530 is deactivated, the warning lights 910 can be automatically turned off. In some other embodiments, the built-in ventilation hood assembly 110 may comprise a control button to turn the warning lights 910 on or off. In an embodiment, the illumination device 610 can also be operatively coupled to the warning lights 910 such that the warning lights 910 are powered when the illumination device 610 is powered.

Figure 10:
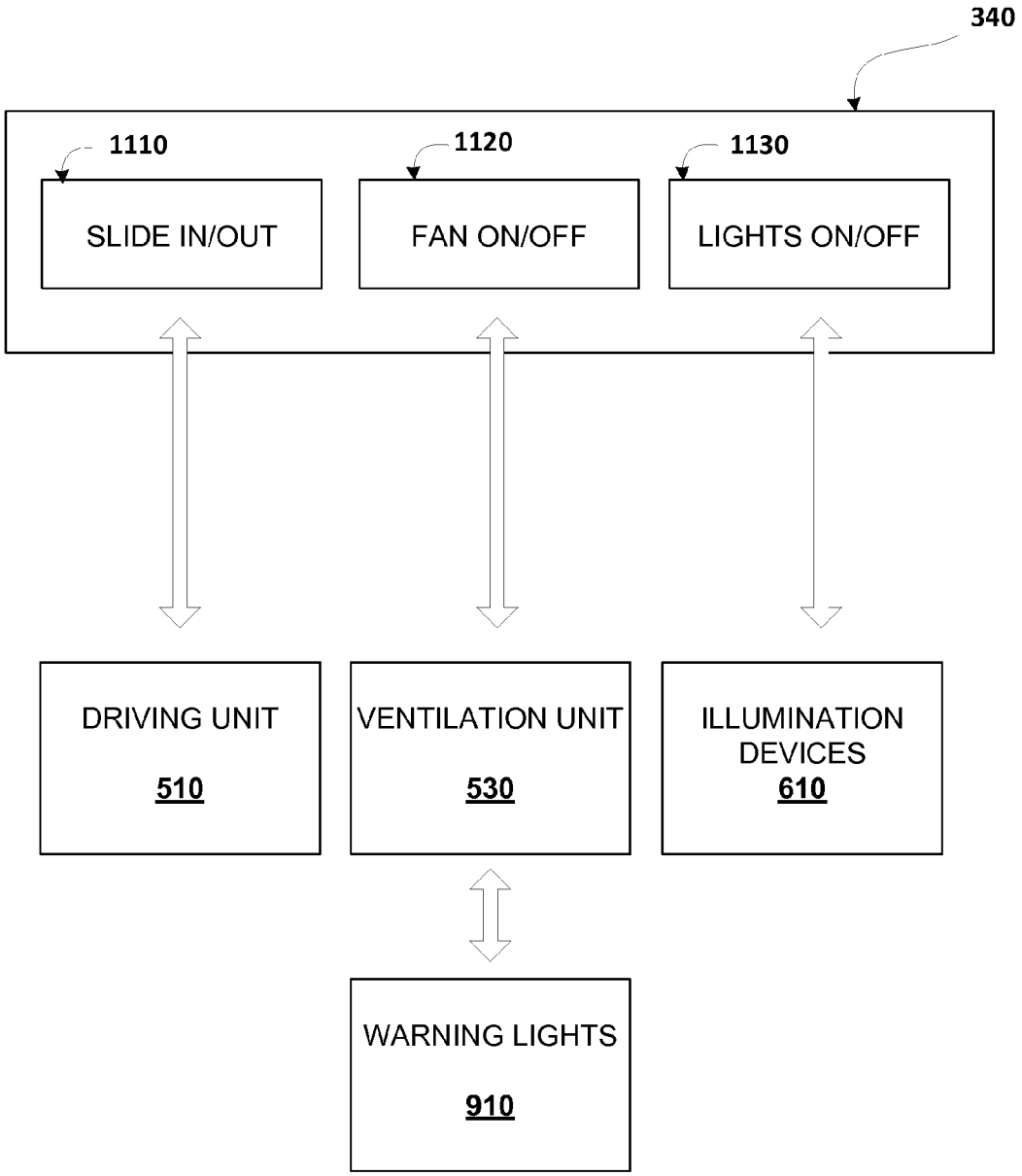
FIG. 10 shows a block diagram of electronic appliances of the built-in ventilation hood assembly and their interconnection, according to an example embodiment.

FIG. 10 shows a block diagram of electronic devices of the built-in ventilation hood assembly 110 and their interconnection, according to an example embodiment. The electronic devices may include the control panel 340, the driving unit 510, the ventilation unit 530 (e.g., the fan), the illumination devices 610, and the warning lights 910. The control panel 340 may comprise one or more operation controls such as buttons. In the example shown, the control panel 340 comprises a 'Slide In/Out' button 1110 to control the driving unit 510, a 'Fan On/Off' button 1120 to control the ventilation unit 530 (and, optionally, the warning lights 910), and a 'Lights On/Off' button 1130 to control the illumination device 610.

When a user presses the 'Slide In/Out' button 1110, the driving unit 510 is energized to slide out the retractable hood unit 320 from the housing 310 or slide it in. Furthermore, when the user presses the 'Fan On/Off' button 1120, the ventilation unit 530 is powered to start blowing. When the user presses this button again, the ventilation unit 530 is caused to stop operation. In various embodiments, the control panel may be provided with multiple buttons to control the ventilation unit 530 and, in particular, to control fan speed. In some other embodiments, each press on the button 1120 may cause a step-like change in the fan rotation speed. Those skilled in the art would appreciate that multiple different button implementations are possible depending on application. When the 'Lights On/Off' button 1130 is pressed by the user, the illumination device 610 is either powered on or powered off.

In yet another embodiment, the built-in ventilation hood assembly 110 may include only one control button. Upon the press of the only control button, the retractable hood unit 320 is slid out to a first position, the fan is activated, and, optionally, illumination device 610 and/or warning lights 910 are turned on. Upon the second press of the only control button, the retractable hood unit 320 is slid out to a second position and keeping the operation of the fan and, optionally, illumination device 610 and/or warning lights 910. The second position may differ from the first position in that the retractable hood unit 320 is slid out of the housing on a greater length in the second position. Upon the third press of the only control button, the retractable hood unit 320 is slid in to the housing 310, while the fan and, optionally, illumination device 610 and/or warning lights 910 are turned off.

Figure 11:
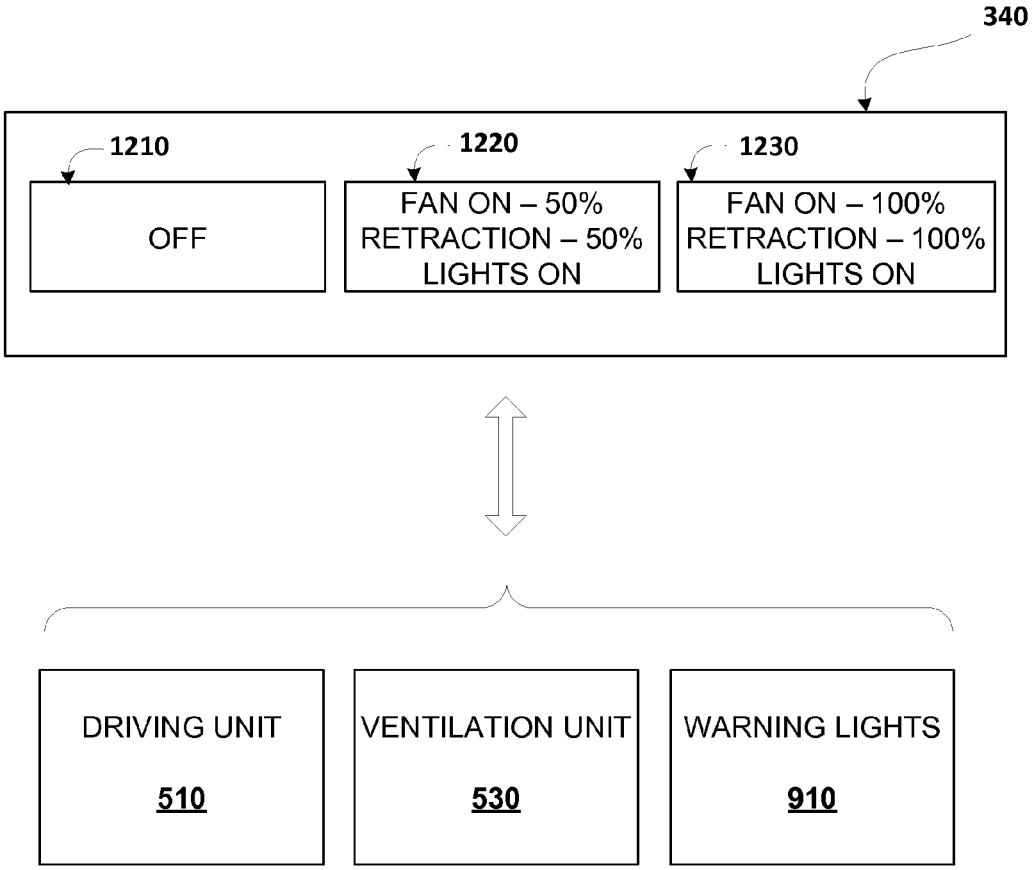
FIG. 11 shows a block diagram of electronic appliances of the built-in ventilation hood assembly and their interconnection, according to another example embodiment.

FIG. 11 shows a block diagram of electronic devices of the built-in ventilation hood assembly 110 and their cooperative operation, according to another example embodiment. In this embodiment, the electronic appliances comprise the control panel 340, the driving unit 510, the ventilation unit 530, and the warning lights 910. The control panel 340 may comprise one or more operation controls such as buttons. In this example, the control panel 340 comprises an 'Off' button 1210, a 'Fan On—50%' button 1220, and a 'Fan On—100%' button 1230. When a user presses the 'Off' button 1210, the driving unit 510 is energized to slide the retractable hood unit 320 into the housing 310 (if the retractable hood unit 320 was in the extended position). Furthermore, upon the 'Off' button 1210 is pressed, the ventilation unit 530 and the warning lights 910 can be powered off. When the user presses the 'Fan On—50%' button 1220, first the driving unit 510 is activated to extend the retractable hood unit 320 to its half-length (in other words, the retractable hood unit 320 is extended to 50% from the housing 310). Further, the ventilation unit 530 is powered to start blowing. In this case, the ventilation unit 530 can be powered at 50% of its entire power. And lastly, the warning lights 910 are automatically powered. When the user presses the 'Fan On—100%' button 1230, the driving unit 510 is activated to extend the retractable hood unit 320 to its full length (in other words, the retractable hood unit 320 is extended to 100% from the housing 310), the ventilation unit 530 is powered to start blowing, and the warning lights 910 are powered to illuminate that the assembly 110 is in use and to indicate its angles and boundaries. Those skilled in the art would appreciate that multiple different buttons can be used, and multiple operating modes can be assigned to them depending on application.

The built-in ventilation hood assembly 110 may also comprise any other circuits, hardware, software, firmware or a combination thereof to provide the functionality of the disclosed embodiments. For hardware implementation, the embodiments can be implemented with processors, controllers, micro-controllers, microprocessors, electronic devices, other electronic units designed to perform the functions described herein, or a combination thereof. Memory can be implemented within a processor or external to the processor. As used herein, the term "memory" refers to any type of long term, short term, volatile, nonvolatile, or other storage device and is not to be limited to any particular type of memory or number of memories, or type of media upon which memory is stored. For firmware and/or software implementation, the embodiments can be implemented with modules such as procedures, functions, and so on, that perform the functions described herein. Any machine readable medium tangibly embodying instructions can be used in implementing the embodiments described herein. The circuits may also comprise, among other things, one or more relays, one or more switches, one or more connection means, and electric wires.

Embodiment 2

Figure 12:
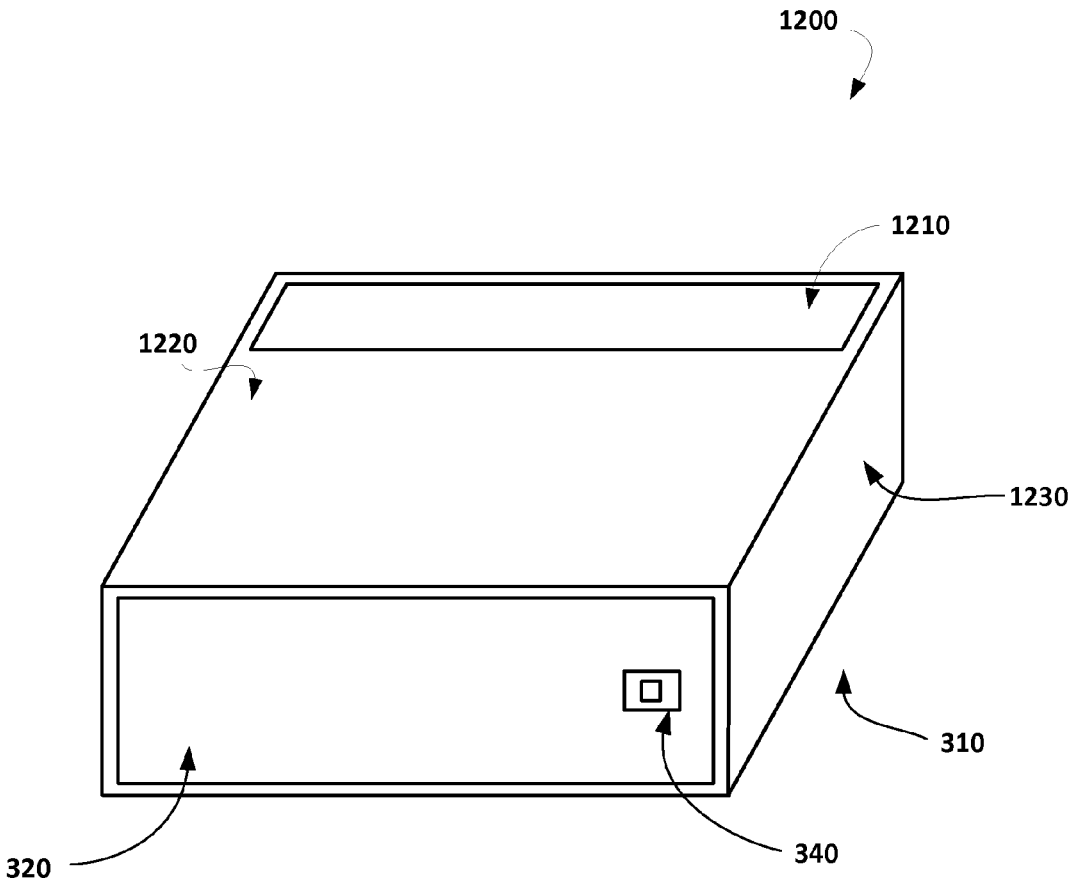
FIG. 12 is a perspective view of the built-in ventilation hood assembly, according to another example embodiment.

FIG. 12 is a perspective view of a built-in ventilation hood assembly 1200, according to an embodiment, which is generally similar to the embodiment shown in FIG. 3. In the shown example, the built-in ventilation hood assembly 1200 includes a housing 310 that has rectangular shape and includes a bottom wall, top wall 1220, and two side walls 1230. There is also an opening 1210 arranged in the top wall 1220 and designed for coupling with an external air conduit. The opening 1210 is generally of rectangular shape and positioned in the rear part of the housing 310.

The assembly 1200 further includes a retractable hood unit 320, which is retracted within the housing 310. The retractable hood unit 320 also has rectangular parallelepiped form such that the retractable hood unit 320 may slide in or out of the housing 310. The assembly 1200 may further include a control panel 340. The control panel 340 may be arranged on the front panel of the retractable hood unit 320 or on any other wall of the housing 340. The control panel 340 may include one or more buttons or other electronic devices to control different units of the built-in ventilation hood assembly 110.

Figure 13:
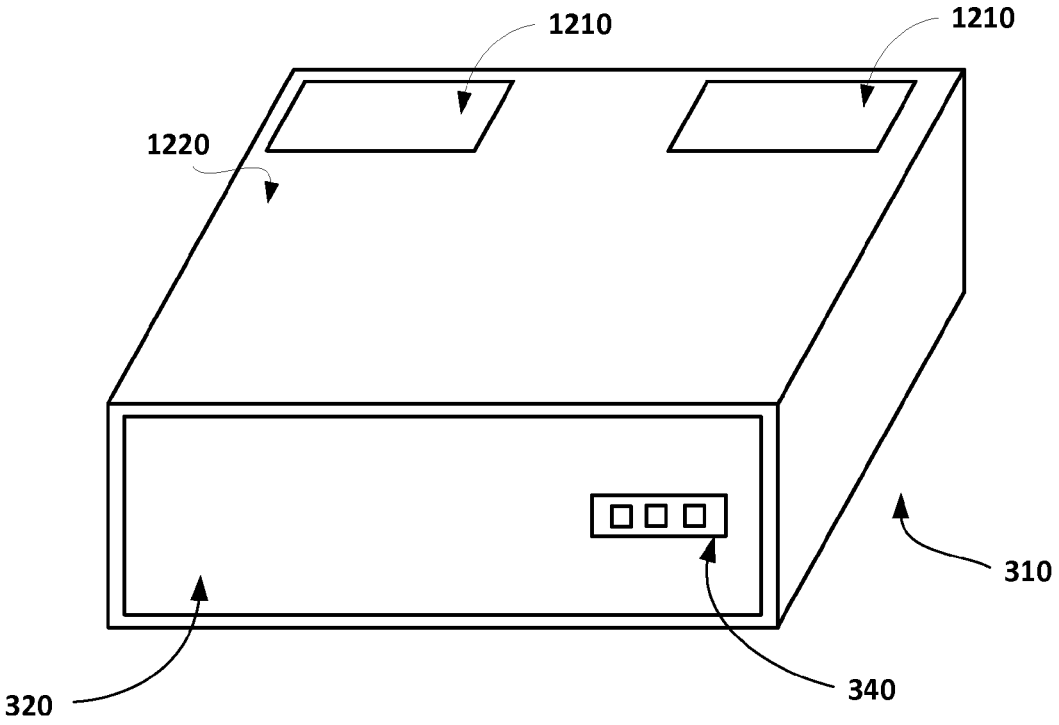
FIG. 13 is a perspective view of the built-in ventilation hood assembly, according to yet another example embodiment.

FIG. 13 is a perspective view of the built-in ventilation hood assembly 1200, according to another embodiment. This embodiment is similar to the embodiment shown in FIG. 12; the only difference is that there are two openings 1210 arranged in the rear part of the top wall. The openings 1210 have rectangular shapes, and their dimensions may generally coincide with dimensions of one or more blowers installed inside the housing 310.

Figure 14:
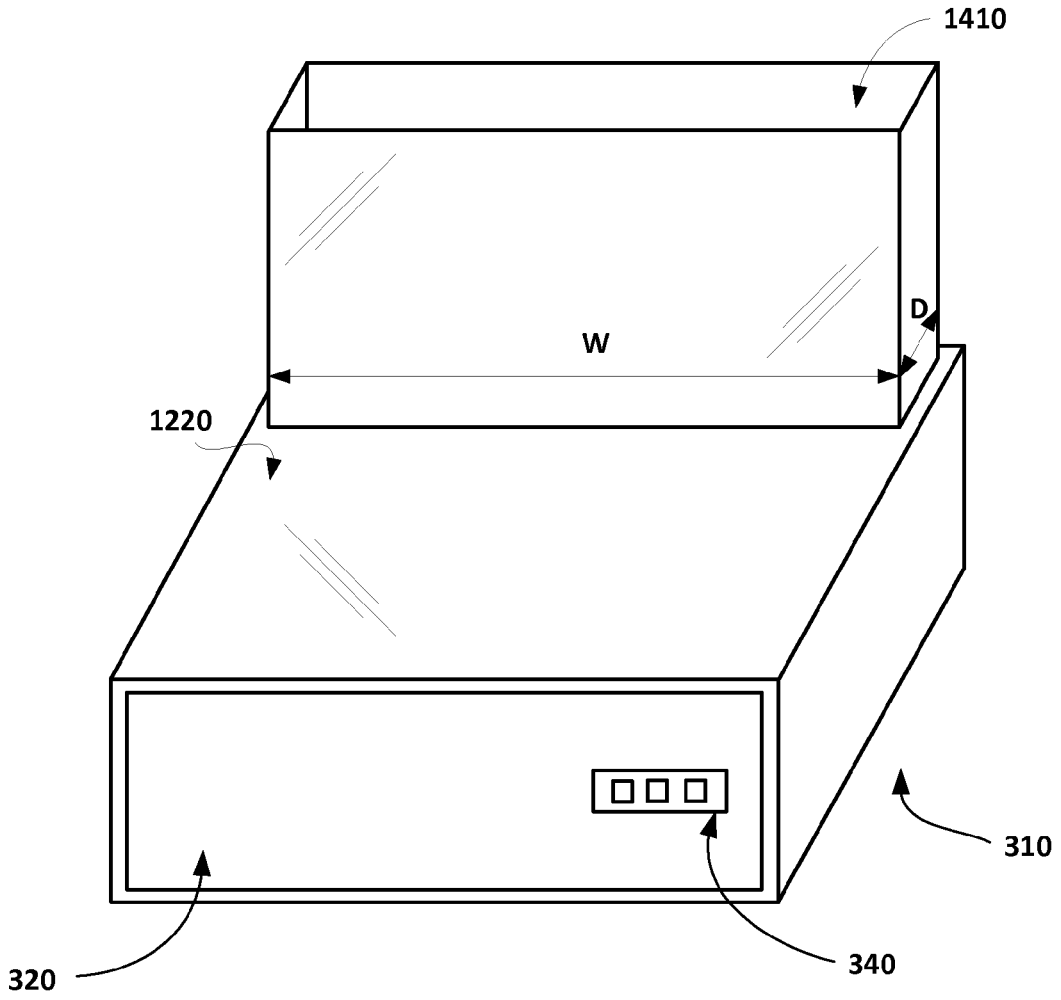
FIG. 14 is a perspective view of the built-in ventilation hood assembly with an external rectangular duct attached, according to an example embodiment.
Figure 15:
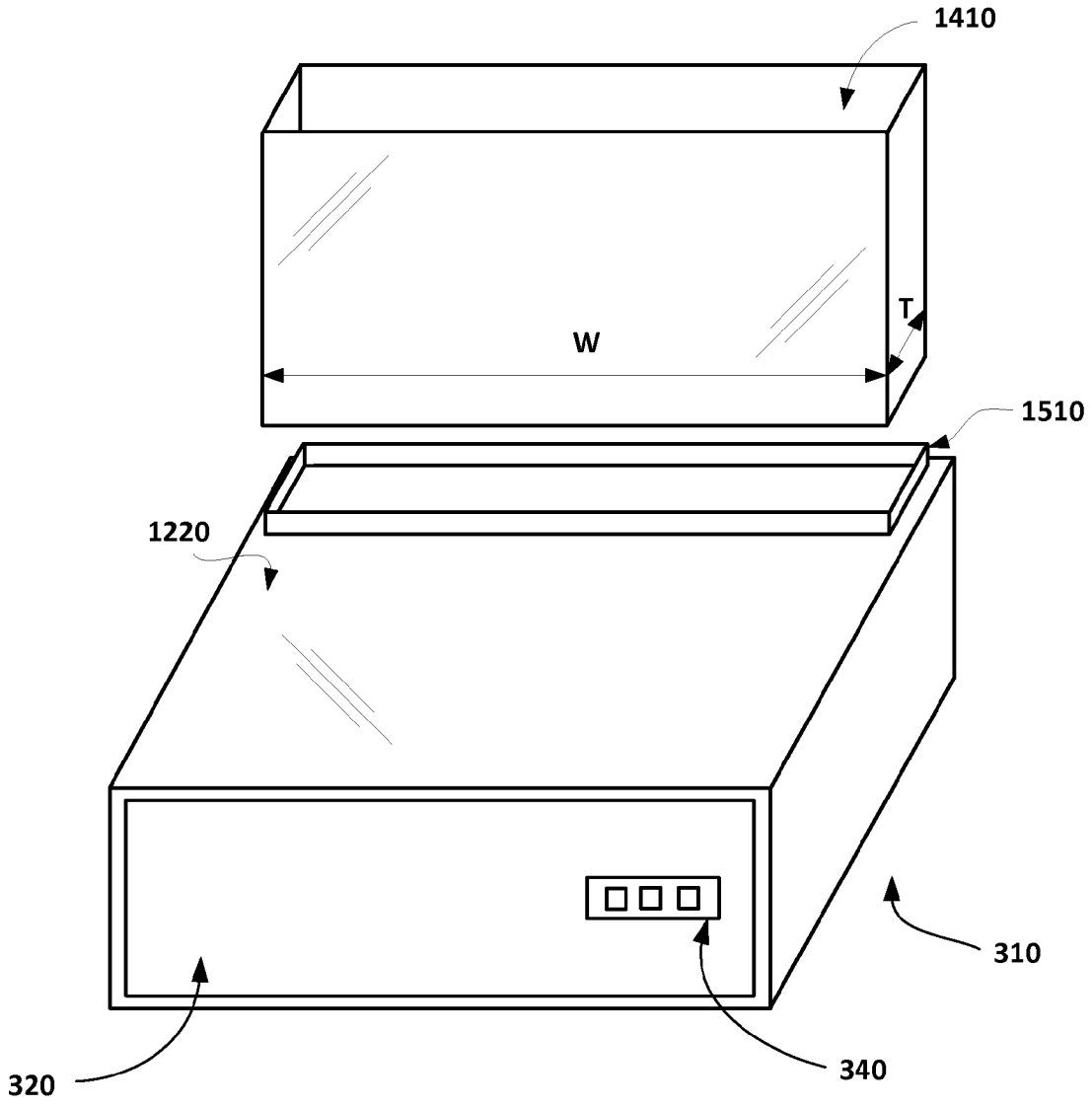
FIG. 15 is a perspective view of the built-in ventilation hood assembly having a flange, and the external rectangular duct attached, according to an example embodiment.

FIG. 14 is a perspective view of the built-in ventilation hood assembly 1200 and also an external rectangular duct 1410 attached to the housing 310. The external rectangular duct 1410 may be designed for transferring the air sucked by the assembly 1200 outside of a premises or building. The dimensions of the external rectangular duct 1410 may be substantially equal to the dimensions of a blower installed inside the housing 310 and/or the dimensions of the opening(s) 1210. More specifically, as shown in the drawing, the width W of the external rectangular duct 1410 is about the same as the width of the built-in cooking device, kitchen cabinet, and the housing 310. For example, the width W may be between 20 and 50 inches, and more specifically between 30-32 inches. The depth D of the external rectangular duct 1410 is about the same as the depth of the opening(s) 1210 or the depth of the air blower. The depth D may be about ⅓ of the depth of the kitchen cabinet or less than ⅓ of the depth of the kitchen cabinet. For example, the depth D may be in between 2-10 inches, and more specifically in between 3-5 inches. Such dimensions of the external rectangular duct 1410 enables it to be housed in the rear part of the kitchen cabinet to allow for enough room for arranging shelves and other furniture elements. Essentially, this design allows making the external rectangular duct 1410 seamless for the users.

The external rectangular duct 1410 may be connected to the housing 310 via a flange 1510, which may have substantially the same dimensions as the external rectangular duct 1410. The external rectangular duct 1410 may be glued, screwed with bolts, or simply inserted into the housing 310. A sealing member may be provided between the external rectangular duct 1410 and the opening(s) 1210.

Figure 16:
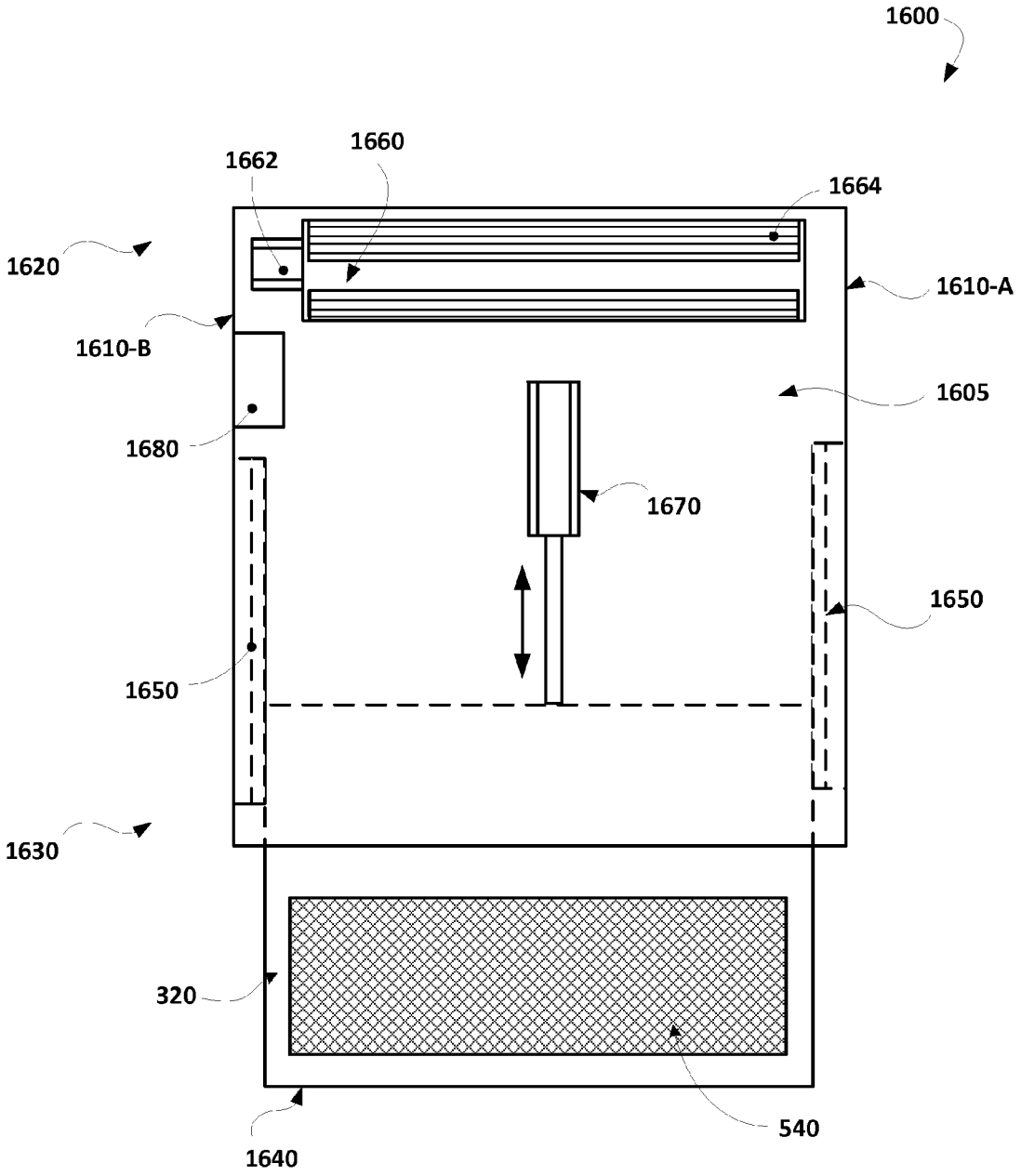
FIG. 16 is a diagrammatic top view of the built-in ventilation hood assembly having the retractable hood unit in the extended position, according to an example embodiment.

FIG. 16 is a high level top view of the built-in ventilation hood assembly 1600 having the retractable hood unit 320 in the slide out (extended) position, according to an example embodiment. The retractable hood unit 320 may be slidably positioned within the housing 310 and be extendable from its front side 1630. In order to provide the ability of moving the retractable hood unit 310, the housing 310 may include one or more bearing slides 1650 (shown in dashed lines) to receive the retractable hood unit 320. In addition to or instead of the bearing slides 1650, there can be used one or more multiple guiding members such as rails, racks, guides, ramps, ribs, shafts, gears, and so forth. The bearing slides 1650 may be arranges on the side walls 1610-A and 1610-B of the housing 310. The retractable hood unit 320 also includes at least one opening 540 in its front part 1640 for sucking air from the area close to the built-in cooking device 120.

The assembly 1600 may also include a liner actuator 1670 fixedly secured to the bottom wall 1605 of the housing 310. More specifically, a main body (i.e., an electric motor) of the linear actuator 1670 may be fixedly attached to the housing 310, while a rod of the linear actuator 1670 may be attached to the retractable hood unit 320. The linear actuator 1670 may be of any suitable type including an electro-mechanical actuator, compact electrical linear actuator, telescoping linear actuator, compact electrical telescoping linear actuator, piezoelectric actuator, pneumatic actuator, thrust, servo driver, and so forth. In most example embodiments shown herein, the linear actuator is a telescoping linear actuator.

Further, the assembly 1600 includes an air blower 1660, which is fixedly secured to the housing 310 in its rear part 1620. In an example embodiment, the air blower 1660 includes a cross flow fan having an electrical motor 1662 and a wheel with blades 1664 arranged on a shaft driven by the electrical motor 1662. The air blower 1660 is designed to suck air through the opening 540, generate a uniform air flow and transfer it out of the housing into the external rectangular duct 1410. In this embodiment, the width of air blower 1660 is slightly less than the width of the housing 310. The crux of the air blower 1660 is that it blows air out uniformly along the entire rectangular opening(s) 1210.

Further, the assembly 1600 may include an electronic unit 1680, which may include one or more electronic devices enabling the operation of the assembly 1600. For example, the electronic unit 1680 may include a processor or controller (e.g., to control the linear actuator, cross flow fans etc.), memory, power transformer, wire connecting unit (hub, ports, sockets), AC/DC converters, sensors, heat sink, switches (electromechanical or sold state), relays, and so forth.

Figure 17:
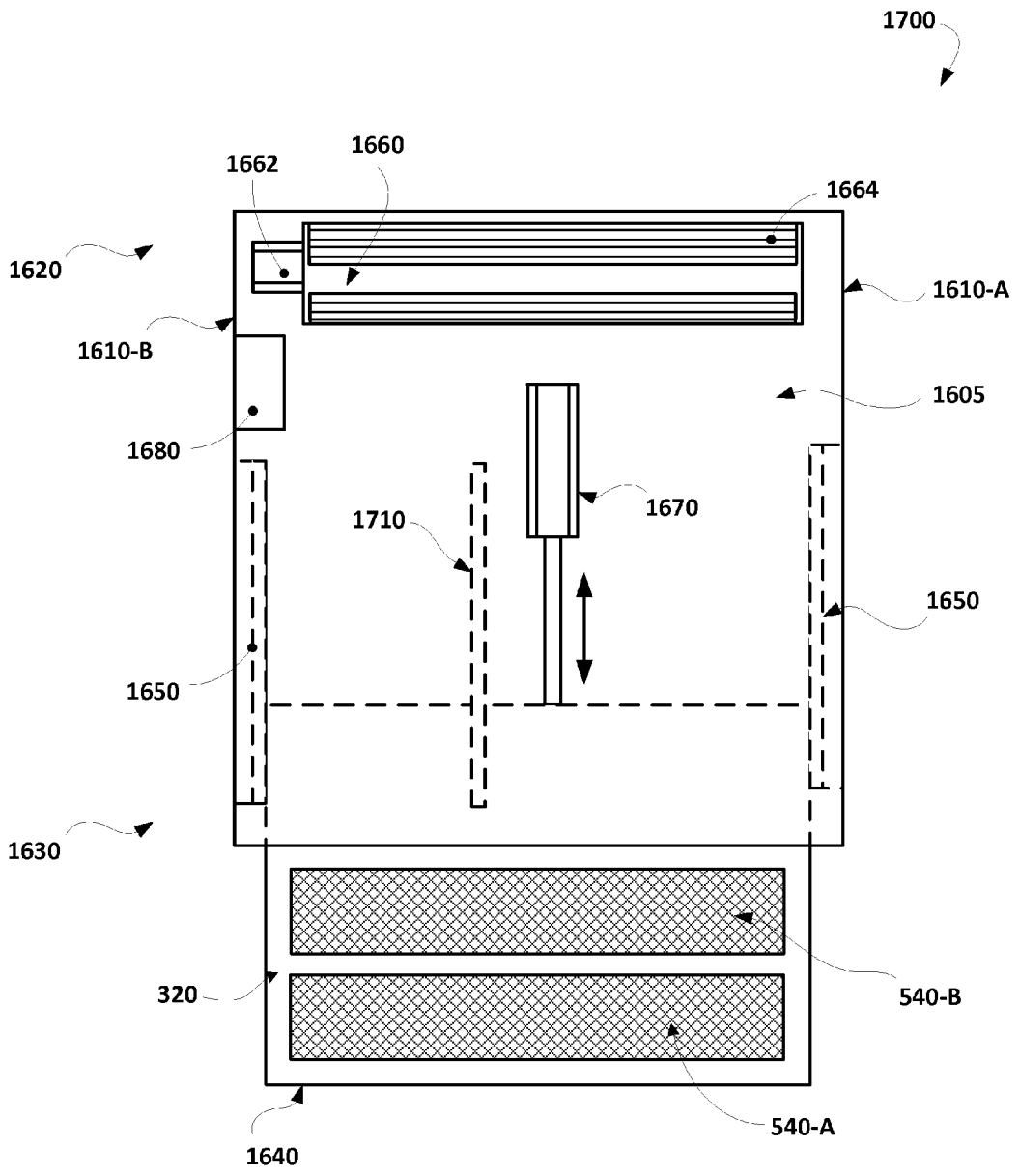
FIG. 17 is a diagrammatic top view of the built-in ventilation hood assembly having the retractable hood unit in the extended position, according to another example embodiment.

FIG. 17 shows an example of built-in ventilation hood assembly 1700, which is similar to the assembly 1600 shown in FIG. 16. In this example embodiment, there are provided additional bearing slides 1710 secured to the bottom wall 1605 of the housing 310. Substantially, the additional bearing slide 1710 may be secured in proximity to the center of the bottom wall 1605. The top wall of the housing 310 may also include one or more additional bearing slides 1710.

Further, there are shown two air openings 540-A and 540-B of the retractable hood unit 320. As already mentioned, the retractable hood unit 320 may slide out and stop in two or more positions. For example, upon a press of a control button, the retractable hood unit 320 is slid out to a first position such that the only first opening 540-A is exposed to intake air. Upon a subsequent press on the control button, the retractable hood unit 320 is slid out to a second position such that both first and second openings 540-A, 540-B are exposed to intake air. Furthermore, in some embodiments, once the retractable hood unit 320 is slid out, the cross air blowers 1660 are automatically activated.

Figure 18:
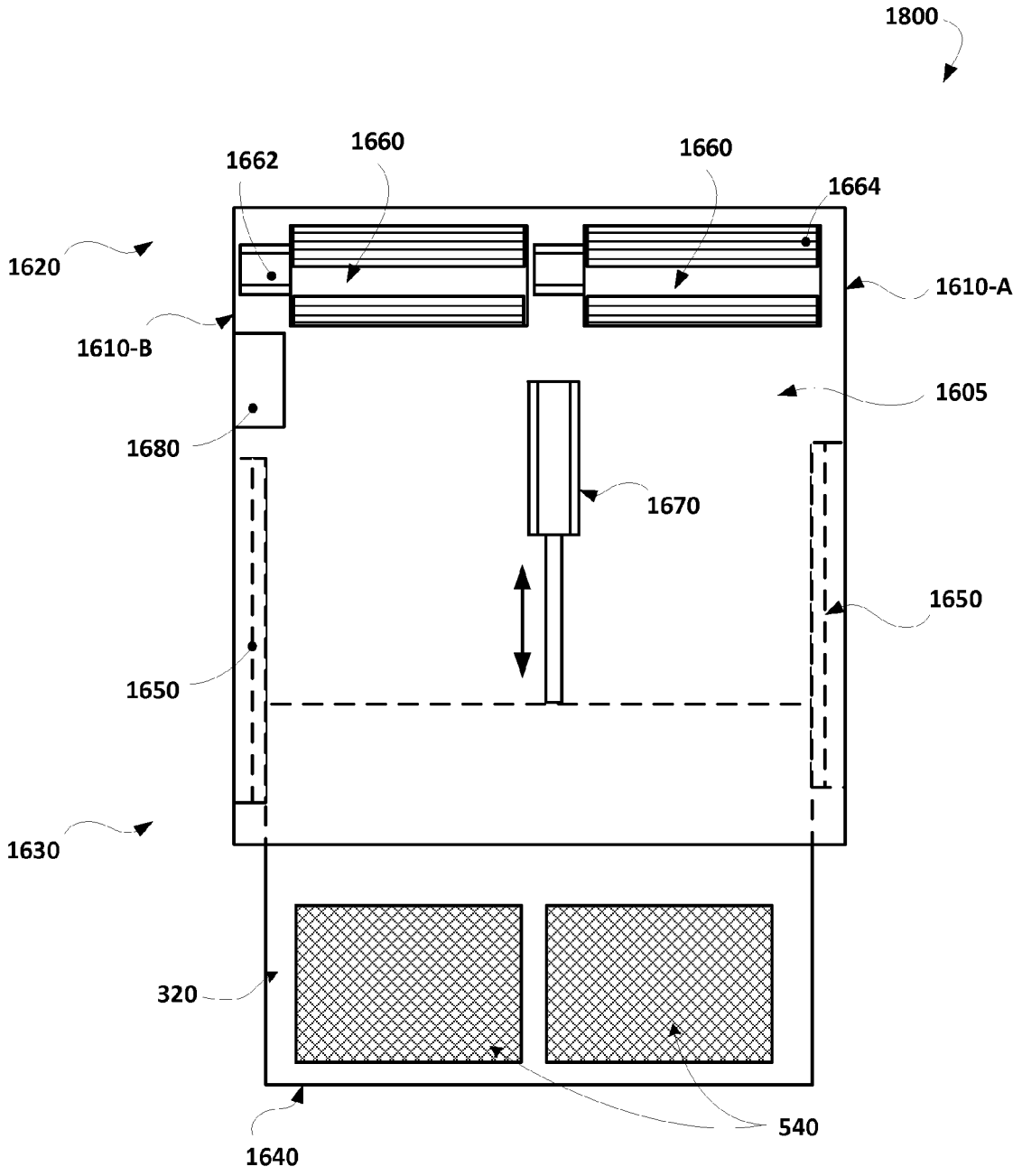
FIG. 18 is a diagrammatic top view of the built-in ventilation hood assembly having the retractable hood unit in the extended position, according to yet another example embodiment, and additionally showing two intake openings and two cross flow fans.

FIG. 18 shows yet another example of built-in ventilation hood assembly 1800, which is similar to the assembly 1600 shown in FIG. 16. In this embodiment, there are also two openings 540, but these are arranged on the same level in the retractable hood unit 320. Further, in this embodiment, there are provided two air blowers 1660, both of them arranged in the rear part 1620 of the housing 310.

Figure 19:
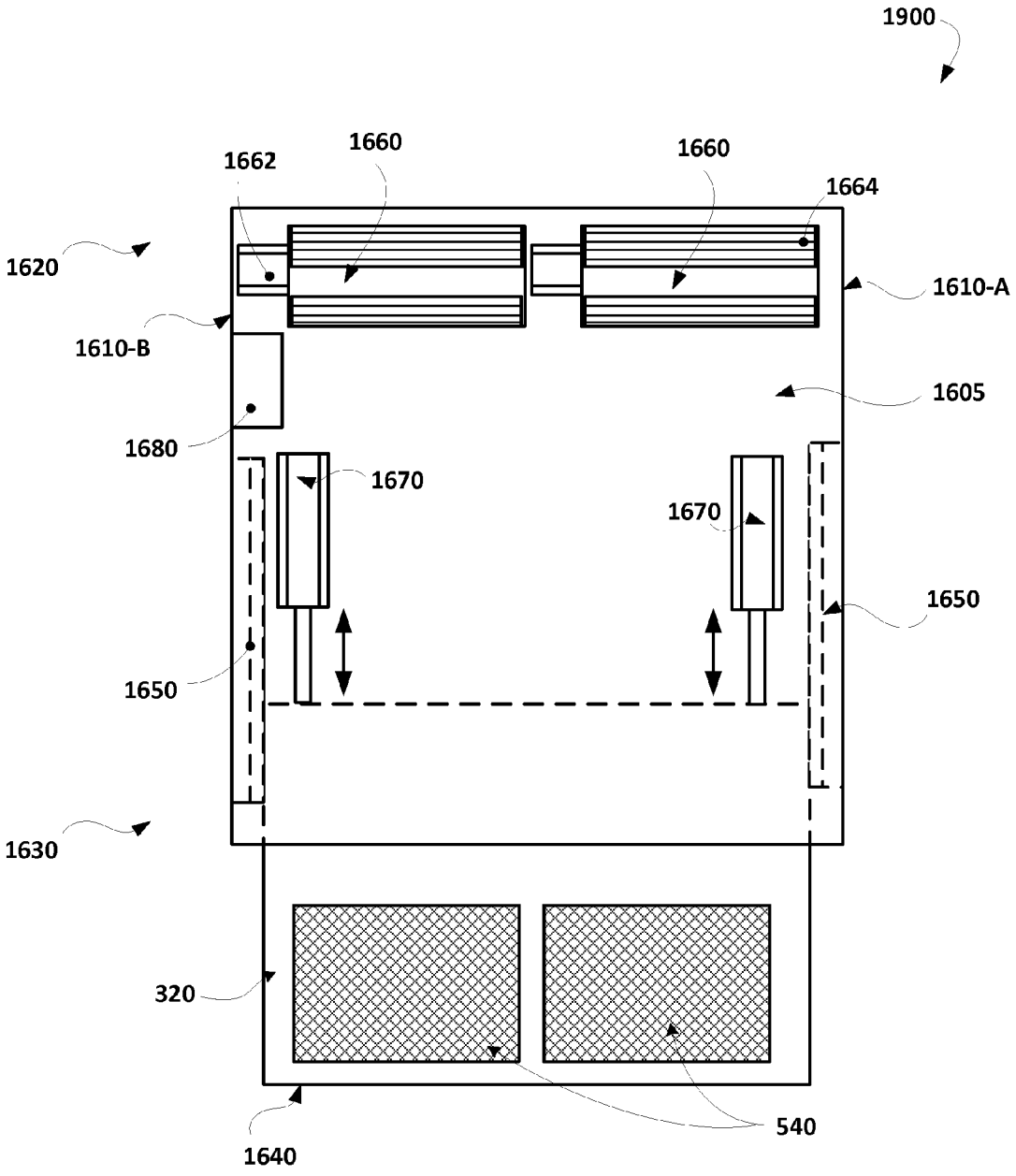
FIG. 19 is a diagrammatic top view of the built-in ventilation hood assembly having the retractable hood unit in the extended position, according to yet another example embodiment, and additionally showing also two linear actuators.

FIG. 19 shows yet another example of built-in ventilation hood assembly 1900, which differs from the previous embodiment in that there are two linear actuators 1670 arranged in proximity to the side walls 1610-A, 1610-B. In some example embodiments, the linear actuators 1670 (e.g., telescopic linear actuators) can be fixedly secured to the side walls 1610-A, 1610-B. The operation of the linear actuators 1670 can be synchronized by a controller.

Figure 20:
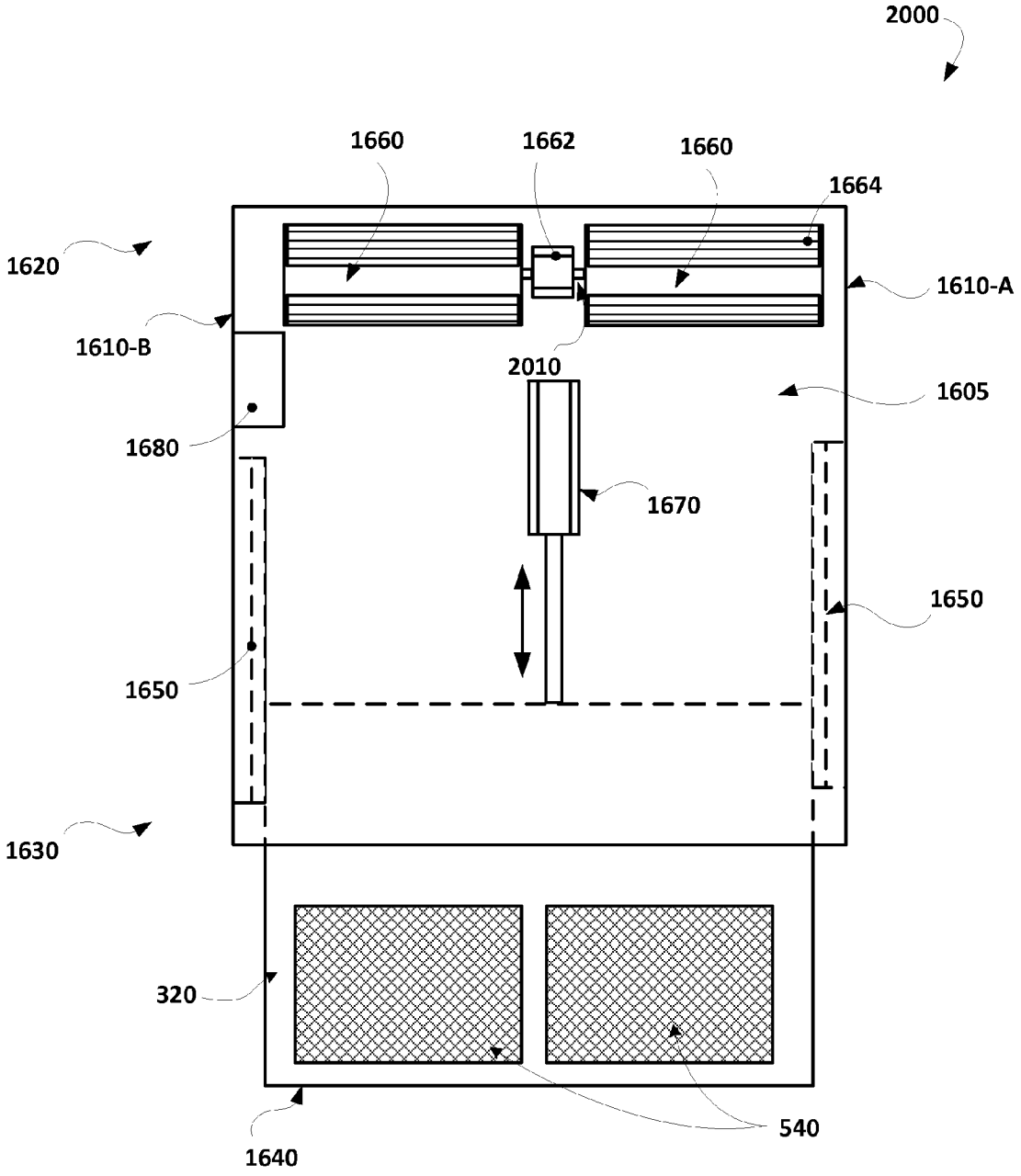
FIG. 20 is a diagrammatic top view of the built-in ventilation hood assembly having the retractable hood unit in the extended position, according to yet another example embodiment, and additionally showing two cross flow fans, which share one common shaft and one electrical motor.

FIG. 20 shows yet another example of built-in ventilation hood assembly 2000. In this example embodiment, the air blower includes two air blowers 1660 which share a single electrical motor 1662. In particular, in this example, the wheels with blades 1664 of both air blowers 1660 are arranged on a single shaft, which is driven by the only electrical motor 1662. Both air blowers 1660 may generate an uniform air flow and blow it out through the opening(s).

Figure 21:
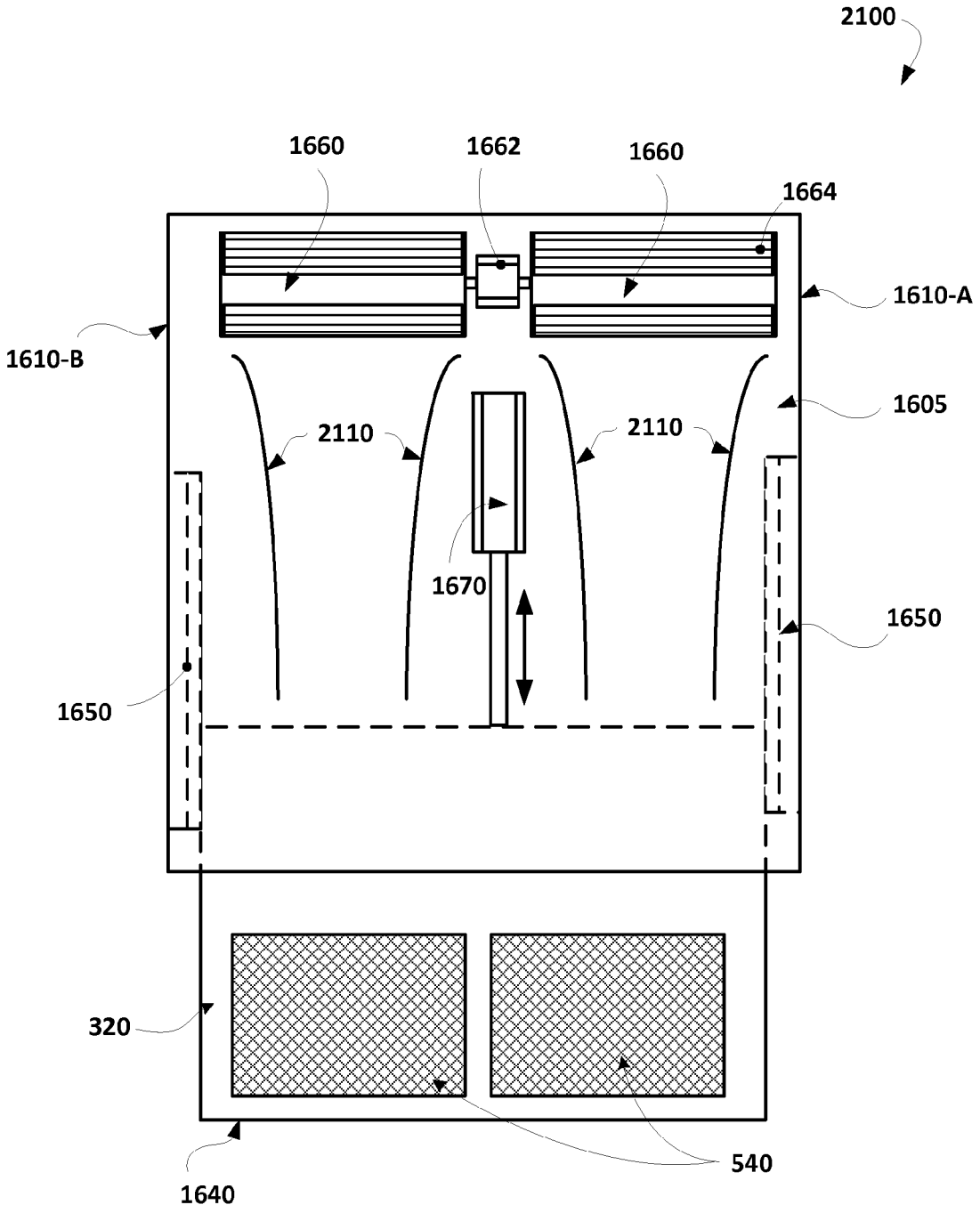
FIG. 21 is a diagrammatic top view of the built-in ventilation hood assembly having the retractable hood unit in the extended position, according to yet another example embodiment showing air guides.
Figure 22:
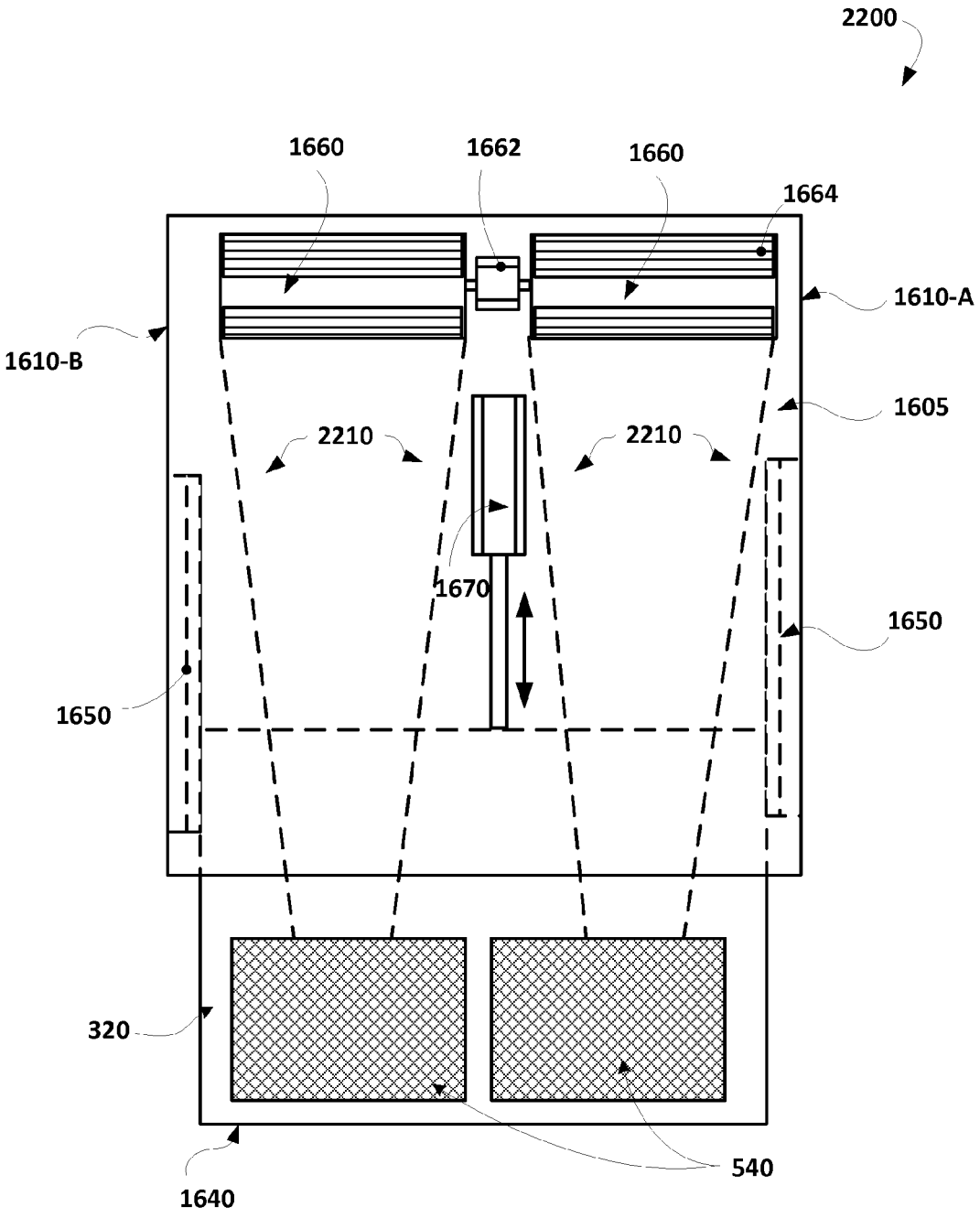
FIG. 22 is a diagrammatic top view of the built-in ventilation hood assembly having the retractable hood unit in the extended position, according to yet another example embodiment, and additionally showing air ducts.

FIG. 21 shows yet another example of built-in ventilation hood assembly 2100. In this example embodiment, there are also provided air guides 2110 for directing air sucked through the opening(s) 540 to the air blower 1660. The air guides 2110 may be implemented as curved panels as shown in this drawing. FIG. 22 shows yet another but similar example of built-in ventilation hood assembly 2200. In this embodiment, there are provided internal ducts 2210. The internal ducts 2210 may be arranged in between the openings 540 and the air blowers 1660 to facilitate drawing air through the assembly 2200. The internal ducts 2210 may include one or more corrugated ducts.

Figure 23:
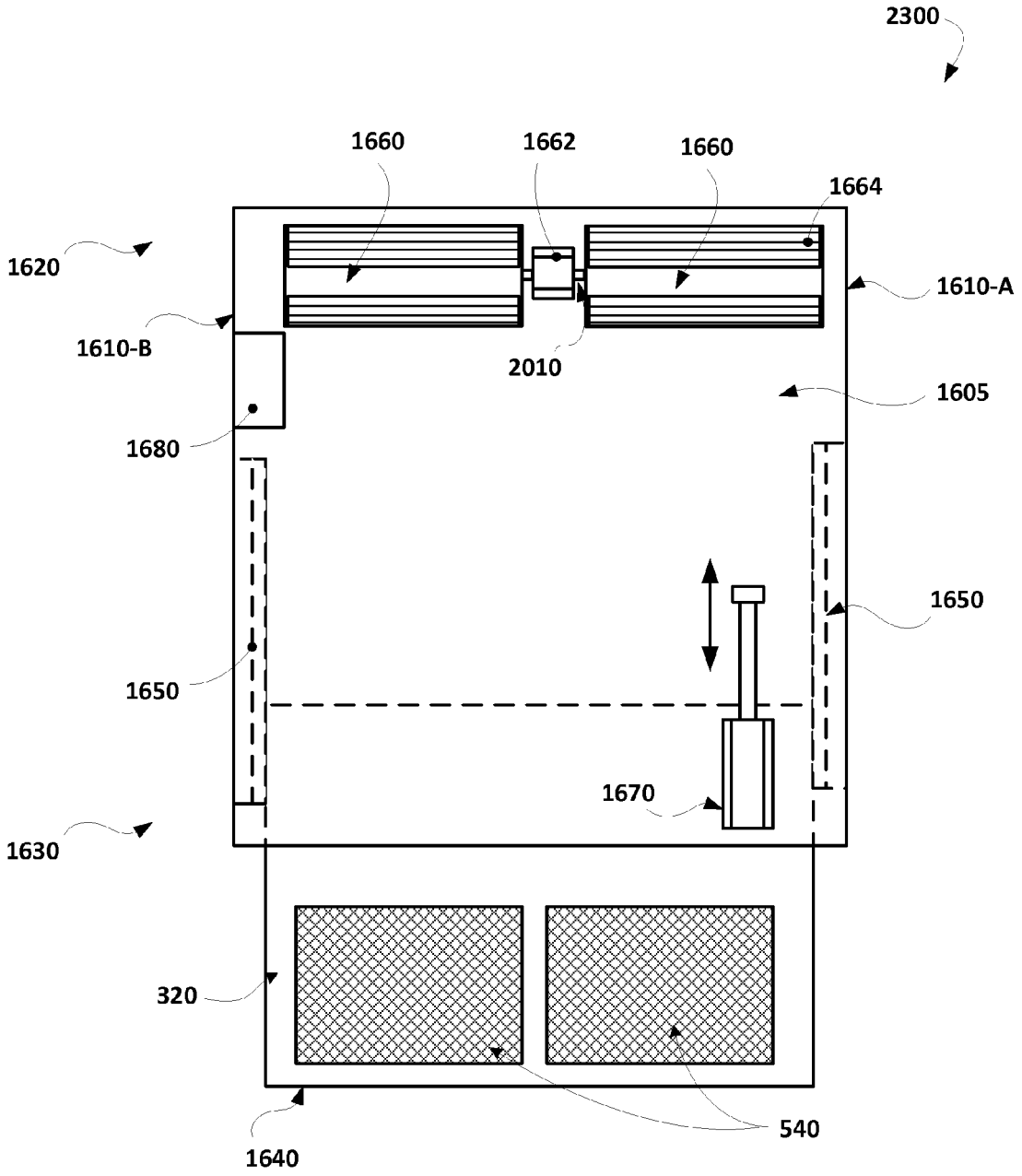
FIG. 23 is a diagrammatic top view of the built-in ventilation hood assembly having the retractable hood unit in the extended position according to yet another example embodiment, and additionally showing a linear actuator, which driver secured to the retractable hood unit.

FIG. 23 shows yet another example of built-in ventilation hood assembly 2300. In this example embodiment, there is provided a linear actuator 1670, the main body of which is fixedly secured to the retractable hood unit 320, while its rod is secured to the housing 310.

Thus, various embodiments of a built-in ventilation hood assembly have been disclosed. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. A built-in ventilation hood assembly for air exhausting, comprising:

a housing for embedding into a kitchen cabinet immediately above a built-in cooking device being installed in the same kitchen cabinet, the housing having a substantially rectangular parallelepiped shape and including at least a bottom wall, a top wall, and two side walls, wherein the top wall includes at least one rectangular opening for air;

a retractable hood unit configured to be slidably mounted within the housing, the retractable hood unit includes at least one air intake into which air is drawn;

a telescoping linear actuator configured to slide out the retractable hood unit from the housing and slide the retractable hood unit back into the housing, wherein a main body of the linear actuator is stationary secured to the bottom wall or the top wall of the housing; and an air blower installed within the housing and in a rear end of the housing, the at least one air blower configured to draw air into the housing through the at least one air intake of the retractable hood unit and uniformly exhaust the air out of the housing through the opening, wherein a rotation speed of the air blower depends on a position of the retractable hood unit being slid out of the housing; and wherein the air blower includes at least one cross flow fan.

2. The built-in ventilation hood assembly of claim 1, wherein the housing is further configured to attach an external rectangular duct for exhausting the air from the housing.

3. The built-in ventilation hood assembly of claim 2, wherein the housing further includes a rectangular flange for securing the external rectangular duct to the housing.

4. The built-in ventilation hood assembly of claim 2, wherein a width of the external rectangular duct is substantially the same as a width of the housing.

5. The built-in ventilation hood assembly of claim 2, wherein a depth of the external rectangular duct is less than five inches.

6. The built-in ventilation hood assembly of claim 1, wherein the at least one opening includes at least one rectangular opening having dimensions substantially equal to dimensions of the at least one blower.

7. The built-in ventilation hood assembly of claim 1, wherein the air blower includes two cross flow fans both arranged in line at the rear end of the housing.

8. The built-in ventilation hood assembly of claim 7, wherein the two cross flow fans are arranged on a single shaft and are driven by a single electrical motor.

9. The built-in ventilation hood assembly of claim 1, further including two bearing slides, each of which is secured to one of the side walls of the housing to enable the retractable hood unit to slide in or out of the housing.

10. The built-in ventilation hood assembly of claim 1, further comprising at least one additional bearing slide secured to the bottom wall or top wall of the housing to enable the retractable hood unit to slide in or out of the housing.

11. The built-in ventilation hood assembly of claim 1, further comprising one or more air guides arranged within the housing for guiding the air from the at least one air intake of the retractable hood unit to the air blower.

12. The built-in ventilation hood assembly of claim 11, wherein the one or more air guides include one or more corrugated ducts.

13. The built-in ventilation hood assembly of claim 1, further comprising a control panel having at least one button, wherein a press on the at least one button causes the retractable hood unit to slide out of the housing or into the housing by actuating the linear actuator, which pushes or pulls the retractable hood unit with a predetermined speed.

14. The built-in ventilation hood assembly of claim 13, wherein one press on the at least one button causes the retractable hood unit to slide a first predetermined distance out of the housing and expose a first opening of the retractable hood unit, and another subsequent press on the at least one button causes the retractable hood unit to slide a second predetermined distance out of the housing and expose a second opening of the retractable hood unit.

15. The built-in ventilation hood assembly of claim 13, wherein the press on the at least one button further causes activation of the air blower.

16. The built-in ventilation hood assembly of claim 1, further includes one or more light emitting devices arranged on a front side of the retractable hood unit, wherein the one or more light emitting devices are automatically activated when the retractable hood unit is slid out of the housing; and wherein the one or more light emitting devices are configured to eliminate light substantially flatwise of the front side of the retractable hood unit for warning a user.

* * * * *